US012601167B2

(12) United States Patent
Uschakow

(10) Patent No.: US 12,601,167 B2
(45) Date of Patent: Apr. 14, 2026

(54) TRANSPORTABLE EXPANDABLE STRUCTURE

(71) Applicant: Andre Uschakow, Schwarzatal (DE)

(72) Inventor: Andre Uschakow, Schwarzatal (DE)

( * ) Notice: Subject to any disclaimer, the term of this patent is extended or adjusted under 35 U.S.C. 154(b) by 232 days.

(21) Appl. No.: 18/581,456

(22) Filed: Feb. 20, 2024

(65) Prior Publication Data

US 2024/0309631 A1 Sep. 19, 2024

(30) Foreign Application Priority Data

Mar. 15, 2023 (UA) ..... a 2023 01062

(51) Int. Cl.
*E04B 1/343* (2006.01)

(52) U.S. Cl.
CPC ..... *E04B 1/3431* (2013.01); *E04B 1/34384* (2013.01)

(58) Field of Classification Search
CPC ..... E04B 1/3431; E04B 1/34384; B60P 3/34; E04H 2001/1283
See application file for complete search history.

(56) References Cited

U.S. PATENT DOCUMENTS 6,601,896 B1 * 8/2003 Nye ..... B60P 3/34 296/26.05
6,685,249 B2 * 2/2004 Schneider ..... B60P 3/34 296/165
6,796,590 B2 * 9/2004 Schneider ..... B60P 3/34 296/172
6,805,391 B2 * 10/2004 Schneider ..... B60P 3/34 74/30

(Continued)

FOREIGN PATENT DOCUMENTS

CN 110512742 A * 11/2019 ..... E04B 1/34331
CN 111591195 A * 8/2020 ..... B60P 3/36

(Continued)

OTHER PUBLICATIONS

Search Report and Opinion for counterpart European Application No. 24025006.8 (5 pages). (Year: 2024).*

*Primary Examiner* — Rodney Mintz
(74) *Attorney, Agent, or Firm* — Nadya Reingand

(57) ABSTRACT

The invention relates to vehicle-transportable expandable structures. The structure comprises a stationary module, slide-out modules, expansion mechanisms and support mechanisms for the slide-out modules, a power supply system, a frame, a control unit. The expansion mechanisms are mounted below and represent "tube in a tube" systems having rollers and motors synchronized between each other. Each support mechanism is formed by at least three profile elements, comprises its own motor, two sets of rollers and vertical masts with reinforcing ropes. The support mechanisms are mounted above and attached to roofs of the stationary module and the slide-out modules. The expansion mechanisms' motors are synchronized between each other and with support mechanisms' motors. The invention achieves: stable, uniform, smooth, mechanized and automated, simultaneous sliding out/retraction of several slide-out modules outwardly from the stationary module; stable and long-term support of the slid-out slide-out modules above and below; increasing a useful living area.

18 Claims, 15 Drawing Sheets

(56) References Cited

U.S. PATENT DOCUMENTS 6,871,897 B1 * 3/2005 Snyder ..... B60P 3/34 296/165
8,555,558 B1 * 10/2013 Trout ..... B60P 3/34 52/67
8,844,212 B1 * 9/2014 Trout ..... E04B 1/34305 52/67
8,959,843 B2 * 2/2015 Trout ..... B60P 3/34 52/67
9,458,621 B2 * 10/2016 Calafatis ..... E04B 1/34336
9,458,623 B2 * 10/2016 Duncan ..... B65D 88/522
9,545,870 B2 * 1/2017 Walls ..... F16H 19/04
10,364,583 B2 * 7/2019 Tanner ..... F24F 13/0236
10,731,329 B1 * 8/2020 Novikov ..... E04B 1/3483
11,846,108 B2 * 12/2023 Pearce ..... E04H 1/1205
2003/0141732 A1 * 7/2003 Nye ..... B60P 3/34 296/26.01
2003/0205911 A1 * 11/2003 Schneider ..... B60P 3/34 296/175
2004/0150241 A1 * 8/2004 Nye ..... B60P 3/34 296/26.01
2005/0062305 A1 * 3/2005 Blaudow ..... B60P 3/34 296/26.01
2011/0254305 A1 * 10/2011 Gogola ..... B60P 3/34 296/26.13
2012/0006369 A1 * 1/2012 Cantin ..... E04B 1/34384 135/96
2012/0151851 A1 * 6/2012 Cantin ..... E04B 1/34336 52/79.5
2013/0305625 A1 * 11/2013 Pike ..... E04B 1/34305 52/64
2013/0305627 A1 * 11/2013 Pike ..... F16B 7/10 52/79.5
2014/0130421 A1 * 5/2014 Trout ..... B60P 3/34 52/67
2014/0360105 A1 * 12/2014 Trout ..... E04B 1/3431 52/79.5
2015/0040700 A1 * 2/2015 Walls ..... F16H 19/04 74/89.17
2015/0267396 A1 * 9/2015 Cantin ..... E04H 1/1205 52/79.5
2015/0292194 A1 * 10/2015 Calafatis ..... E04B 1/34321 52/67
2015/0315776 A1 * 11/2015 Duncan ..... E04B 1/3444 52/66
2015/0315807 A1 * 11/2015 Pike ..... E04H 15/32 135/97
2017/0198485 A1 * 7/2017 Tanner ..... F24F 13/0209
2021/0246675 A1 * 8/2021 Pearce ..... E04B 1/3448
2022/0154447 A1 * 5/2022 Schumann ..... E04B 1/3431
2024/0060290 A1 * 2/2024 Kleine-Natrop ..... B65D 88/005
2024/0295133 A1 * 9/2024 Hall ..... E04B 1/3444

FOREIGN PATENT DOCUMENTS

CN 216153862 U * 4/2022
CN 217145798 U * 8/2022
JP 2022160344 A * 10/2022

* cited by examiner

TRANSPORTABLE EXPANDABLE STRUCTURE

CROSS-REFERENCE TO RELATED APPLICATIONS

The current application claims priority to Ukrainian patent application No. a 2023 01062 filed on Mar. 15, 2023, incorporated herein by reference in its entirety.

FIELD OF THE INVENTION

The invention relates to transportable expandable structures to be transported by any vehicles to any usage locations. The structure is to be used as a residential building for living or as a mobile medical station or as a mobile command center or for other needs. The structure can be used all year around due to thermal insulation that meets standards for usual residential rooms and to provision of all household conditions (heating, water supply, thermal insulation, other life support systems). When slide-out modules are unfolded, the structure area will increase as much as possible. In preferable embodiments of the invention, there is no need in registering the structure as a vehicle, since it is simply a cargo that is transported, e.g., on a common trailer. The invention is a transportable expandable structure.

BACKGROUND

In the modern world, a possibility of creating a human living place that would not be related to stationary communications (city or other communications) and which could be quickly transported to a required location for a long time and quickly and conveniently re-transported becomes increasingly important. This is important for civilians as well as for military personnel, doctors, special services etc. In such solutions, it is very important to provide a maximum living area, while ensuring a minimum transportation volume, stability and reliability of operation of all systems during unfolding/folding of the structure as well as during its usage.

Currently, there are numerous similar technical solutions, and each of them has its own structural features which perform various technical tasks.

A structure named "Expandable motor home frame and motor home" is known (Chinese utility model patent CN216153862 (U), IPC B60P3/345; B60P3/363; B62D21/14, publ. on 1 Apr. 2022 [1]). This structure comprises a stationary module that comprises a floor, two opposite walls, a roof ceiling and at least one door opening, and one slide-out module that is accommodated inside the stationary module movable and is slidable out/retractable in width (i.e., on the side) outwardly from/to the stationary module outside the structure, and the slide-out module further comprises its own floor, at least three walls and a roof ceiling. An objective of this motor home is to create one slide-out module in order to increase a beneficial use area. However, this utility model does not achieve an objective of increasing the beneficial area as much as possible by simultaneous presence of at least several slide-out modules.

A structure named "A shipping container" is known (US invention patent US2021246675 (A1), IPC E04H1/12, B65D88/121; E04B1/3444; E04H1/1205; E04H2001/1283, publ. on 12 Aug. 2021 [2]). This structure is based on a marine shipping container that has been improved to cover living needs. This shipping container can be transported by other vehicles and then configured as a living room, and it comprises a stationary module having a floor, walls, a ceiling, a roof and at least one door opening, as well as a power supply system. However, this solution does not imply use of slide-out modules which allow to increase a living space itself significantly.

"Foldable loading compartment of pickup truck" is known (Chinese utility model patent CN217145798 (U), IPC B60P3/345, publ. on 9 Aug. 2022 [3]). This device is to be transported on a cargo bay of a car and then removed and mounted on a horizontal surface. The foldable loading compartment of the pickup truck comprises a stationary module having a floor, walls, a roof ceiling and at least one door opening. Furthermore, this device further comprises slide-out modules which are accommodated inside the stationary module and are movable and slidable out outwardly from the stationary module outside the structure. An objective of the utility model is to provide a foldable and loadable camping box for pickup trucks which, however, has a structure that does not achieve an objective of creating a transportable expandable structure which could be able to quickly, easily and reliably increase the living space in a mechanized and automated way, and which could be used as a residential building for living or as a mobile medical station or as a mobile command center or for other needs.

The closest technical solution of the claimed invention is "A mobile house structure" that is intended for mounting and creating various facilities such as stores, meeting places, medical centers, restaurants etc. (Japanese invention patent JP2022160344, IPC B60P3/345; E04B1/343; E04H1/12; E04H3/02; E04H3/08; publ. on 19 Oct. 2022 [4]). This device is a transportable expandable structure comprising a stationary module that comprises a floor, two opposite walls, a ceiling (at the same time acting as a roof) and at least one door opening, at least two slide-out modules which are accommodated inside the stationary module and are movable and slidable out in width outwardly from the stationary module outside the structure. Each slide-out module has its own floor, at least three walls and ceiling (at the same time acting as a roof). Besides, this structure of the transportable expandable house further comprises more than one expansion mechanism for sliding out the slide-out modules outwardly from the stationary module and more than one support mechanism for supporting the slide-out modules, and the expansion mechanisms are mounted in the structure horizontally in width in such a way that their elements are connected to the stationary module and to the slide-out modules, and each expansion mechanism is formed by at least a stationary guiding tie, a movable slide-out element and rollers. Also, the expansion mechanisms are mounted in an upper part of the structure horizontally in width in such a way that their elements are connected to the stationary module and to the slide-out modules. Each of the support mechanisms comprises at least a stationary profile beam, a movable slide-out element and rollers. This device further comprises a power supply system. Said invention enables to mount a stationary multi-functional house easily and quickly, and this house may be quickly and easily loaded on a truck as well as loaded as a transportable house.

However, the described structure has high overall dimensions and volume as well as complex systems for expanding the modules and holding them in the stationary state. This large and complex transportable house is more suitable for long-term usage at one single location, since it is impossible to load and to transport it on a trailer of a light vehicle. Furthermore, this structure is not able to provide quick, stable, uniform, smooth, mechanized and automated simultaneous sliding out of several slide-out modules outwardly from the stationary module, as well as this house does not provide quick, stable, uniform, smooth mechanized and automated simultaneous retraction of several slide-out modules inside the stationary module of the structure. Also, said structure comprises complex hydraulic expansion mechanisms which also are support mechanisms for supporting the slide-out modules, thereby complicating their operation, reducing the reliability of support of heavy slide-out modules.

A technical objective of the claimed invention to provide a transportable expandable structure which could be able to quickly, easily and reliably increase the living space in a mechanized and automated way, and which could be used as a residential building for living or as a mobile medical station or as a mobile command center or for other needs.

The technical effects which are achieved by the invention owing to all the essential features, including its novel features, lies in:

- providing stable, uniform, smooth, mechanized and automated simultaneous slide-out of several slide-out modules outwardly from the stationary module, as well as providing stable, uniform, smooth, mechanized and automated simultaneous retraction of several slide-out modules inside the stationary module of the structure;
- providing stable and long-term support of the slid-out slide-out modules at the top and without providing any lower supports for them;
- providing stable and rigid support of the slid-out slide-out modules at the bottom and without providing any lower supports for them;
- providing a maximum increase of the beneficial area.

Additional technical effects lie in:

- providing convenient and quick loading/unloading of the structure to/from trailers and to/from vehicle cargo bays without any additional mechanisms;
- enabling automated and mechanized horizontal alignment of the structure, when it is mounted on rough surfaces (soil, grass surface, stony surface, sand surface etc.).

SUMMARY OF THE INVENTION

The objective is achieved by a transportable expandable structure 1 comprising a stationary module 2 that comprises a floor, two opposite walls, a ceiling and at least one door opening, at least two slide-out modules 3 that are accommodated inside the stationary module 2 and are movable and slidable out in width outwardly from the stationary module 2. Each slide-out module 3 comprises its own floor, at least three walls and ceiling. Besides, the transportable expandable structure 1 comprises more than one expansion mechanism 6 for sliding out the slide-out modules 3 outwardly from the stationary module 2 and more than one support mechanism 13 for supporting the slide-out modules 3. The expansion mechanisms 6 are mounted in the structure 1 horizontally in width in such a way that their elements are attached to the stationary module 2 and to the slide-out modules 3, and each expansion mechanism 6 is formed by at least a stationary guiding tie 7, a movable push-out element 8 and rollers 9, and the support mechanisms 13 are mounted in an upper part of the structure 1 horizontally in width in such a way that their elements are attached to the stationary module 2 and to the slide-out modules 3, and each of the support mechanisms 13 comprises at least a stationary profile beam 14, a movable push-out element 15 and rollers 39. Besides, the transportable expandable structure 1 comprises a power supply system.

A novel feature is that a frame 4 with trusses 5 is arranged in a lower part of the structure 1, the trusses are stationary and immovable elements, and the stationary module 2 with the slide-out modules 3 is mounted on the trusses. Besides, the transportable expandable structure 1 comprises a control unit 29 having a controller, software and wireless communication means, and the control unit 29 is in a communication with control elements for controlling movements of the expansion mechanisms 6 and with all electronic elements of the structure 1. Each expansion mechanism 6 is mounted in a lower part under the floor of the stationary module 2 between sections of the stationary frame 4 and is arranged horizontally in width and transversely to the stationary module 2. Each expansion mechanism 6 is a "tube in a tube" system, where an external tube is the stationary guiding tie 7, while an internal movable push-out tube 8 is the movable push-out element, and the rollers 9 are mounted between walls of the stationary guiding tie 7 and of the internal movable push-out tube 8, and the stationary guiding tie 7 of each expansion mechanism 6 is rigidly attached to the stationary frame 4 in the lower part of the stationary module 2, while the internal movable push-out tube 8 of each of the expansion mechanisms 6 is rigidly connected to a lower horizontal plane of the corresponding slide-out module 3. Each expansion mechanism 6 comprises a linear motor 10 that is mounted adjacent to the corresponding stationary guiding tie 7, and a rod of the linear motor 10 is rigidly connected to the corresponding internal movable push-out tube 8 in order to provide the tube with a mechanical horizontal movement. All the linear motors 10 of all of the expansion mechanisms 6 are connected to the control unit 29, and all the expansion mechanisms 6 and their linear motors 10 are synchronized between each other. Each of the support mechanisms 13 is formed by at least three profile elements, namely, from two stationary U-shaped profile beams 14 and an internal movable push-out tube 15 that is movably mounted between them, and each of the support mechanisms 13 comprises a first set of rollers 40, 41 that is mounted at a start point of the support mechanism 13 and a second set of rollers 16, 39 that is mounted at an end point of the support mechanism 13. Each of the support mechanisms 13 comprises at least two vertical masts 17 that are oppositely mounted on the internal movable push-out tubes 15, while two reinforcing ropes 18 extending through openings 19 of the masts 17 along the entire corresponding internal movable push-out tube 15 at a top and at a bottom, and ends of the ropes are fixed at ends of this internal movable push-out tube 15. Each of the support mechanisms 13 comprises a linear motor 44 that is attached to one of the stationary U-shaped profile beams 14, and a rod 45 of the linear motor 44 is rigidly connected to the corresponding internal movable push-out tube 15 in order to provide the tube with a mechanical horizontal movement. All the linear motors 44 of all of the support mechanisms 13 are connected to the control unit 29, and all the support mechanisms 13 and their linear motors 44 are synchronized between each other as well as synchronized with the expansion mechanisms 6 and with their linear motors 10. Each of the support mechanisms 13 is mounted in the upper part of the structure 1 horizontally in width and transversely to the stationary module 2 in such a way that the stationary U-shaped profile beams 14 of the support mechanisms 13 are rigidly attached to a horizontal plane of the ceiling of the stationary module 2, and the internal movable push-out tubes 15 are rigidly attached to vertical planes of the ceilings of the corresponding slide-out modules 3 by means of brackets 42.

For some specific conditions, embodiments and applications of the inventive structure, the claimed transportable expandable structure is characterized by the following features, which develop, specify a set of features provided in independent claim.

A magnet 11 is mounted on the rod of each linear motor 10 of each of the expansion mechanisms 6, and magnetic sensors 12 are mounted on an outer casing of each of these linear motors 10, the magnetic sensors form "check points" for transmitting, to the control unit 29, certain signals about certain positions of the linear motors 10 and of the internal movable push-out tubes 8 which the slide-out modules 3 are attached to.

The transportable expandable structure 1 comprises four slide-out modules 3 which are mounted so as the slide-out modules 3 are slidable out/retractable in pairs from each side of the stationary module 2, and pairs of the slide-out modules 3 sliding out towards one side are rigidly bound together, and six support mechanisms 13 which are arranged pairwise are mounted in the upper part of the structure 1 horizontally in width and transversely to the stationary module 2, meaning that there are totally three pairs of the support mechanisms 13 which are arranged in such a way that one paired support mechanism 13 is arranged at a center of the structure 1, while two other paired support mechanisms 13 are arranged at edges along a front part and a rear part of the structure 1, and, accordingly, each pair of the slide-out modules 3 bound together is connected to the three support mechanisms 13 in the upper part, besides, four expansion mechanisms 6 are mounted pairwise in the lower part of the structure 1 in the frame 4 in such a way that one expansion mechanism 6 of each pair is movable in one direction from the stationary module 2, while another expansion mechanism 6 of each pair is movable in an opposite direction from the stationary module 2.

The transportable expandable structure comprises three pairs of the support mechanisms 13 having the corresponding systems of rollers 16, 39, 40, 41, and each of the three pairs of the support mechanisms 13 comprises two internal movable push-out tubes 15, and each tube is connected to the rod 45 of the corresponding individual linear motor 44, and at least four stationary U-shaped profile beams 14 which are arranged and made in such a way that two internal movable push-out tubes 15, by means of the corresponding linear motors 44, are movable and pushable out/retractable in opposite directions, while all the stationary U-shaped profile beams 14 remain stationary.

A magnet 11 is mounted on the rod 45 of each linear motor 44 of each of the support mechanisms 13, and magnetic sensors 12 are mounted on an outer casing of each of these linear motors 44, the magnetic sensors form "check points" for transmitting, to the control unit 29, certain signals about certain positions of the linear motors 44 and of the internal movable push-out tubes 15 which the slide-out modules 3 are attached to.

An additional U-shaped stationary profile beam 37 is mounted in the structure of the support mechanism 13 adjacent and parallel to each stationary U-shaped profile beam 14, and these beams 14 and 37 mounted in parallel are bound together by an upper U-shaped profile element 38 in their upper parts along the entire length.

The stationary U-shaped profile beams 14 of the pairs of the support mechanisms 13, the beams are arranged adjacent and parallel in their upper parts, are bound together by the upper U-shaped profile element 38 along the entire length.

The stationary U-shaped profile beams 14, 37 in the structure of the support mechanism 13 are mounted and fixed on additional profile elements/tubes 43 in order to provide a rigidity of the structure and to attach the elements of the support mechanism 13 to the stationary module 2 and to the slide-out modules 3.

The transportable expandable structure 1 comprises at least four lifting mechanisms 20 having elements which are movable vertically upwards/downwards, and four or more lifting mechanisms 20 are vertically mounted and attached either to the stationary module 2 or to both the stationary module 2 and the slide-out modules 3. Each lifting mechanism 20 is a "tube in a tube" system having internal rollers 23, the system is formed by an external stationary tube 21 and by an internal movable tube 22, while the rollers 23 are mounted between walls of the external stationary tube 21 and walls of the internal movable tube 22. Each external stationary tube 21 is rigidly attached to the corresponding module, while each internal movable tube 22 is mounted so as to be movable vertically upwards/downwards relative to the corresponding external stationary tube 21 and, accordingly, relative to the specific module which this external stationary tube 21 is attached to. Each lifting mechanism 20 comprises a linear motor 25, a reduction gear 27 and a ball screw pair 26 which together form a motion transmission assembly for transmitting the motion upwards/downwards from the linear motor 25 to the internal movable tube 22. All the linear motors 25 of all of the lifting mechanisms 20 are connected to the control unit 29.

The lifting mechanisms 20 comprise weight sensors 28 and position sensors 60 which are connected to the control unit 29, besides, the stationary module 2 has tilt sensors which are mounted therein and are also connected to the control unit 29.

The transportable expandable structure 1 comprises support brackets or supporting and fastening elements for providing a horizontal mounting or mounting and fastening on a trailer or on a cargo bay of a vehicle.

The transportable expandable structure 1 comprises a wheeled chassis that is arranged in the lower part of the stationary module 2.

The control unit 29 comprises wireless communication means and software which are configured to exchange signals, data and information with personal electronic digital user devices.

The transportable expandable structure 1 comprises a ventilation system and/or a heating system and/or a water supply-sewerage system and/or a thermal insulation system and/or a noise insulation.

A box structure 30 is mounted under the floor and under a bottom of the stationary module 2, the box structure has rigid tubes 31 accommodated inside it, the rigid tubes are interconnected by flexible hoses 32 and supply the water and/or the heat to the slide-out modules 3, and the interconnected rigid tubes 31 and the flexible hoses 32 are connected to other water supply and/or heat supply means which are arranged in the stationary module 2 and in the slide-out modules 3.

Thermal insulation plates or polyisocyanurate (of a PIR type) plates are used as thermal insulation elements for the walls, the ceilings and other elements of the stationary module 2 and/or of the slide-out modules 3, while a vacuum glass is used for windows and for other transparent elements of the transportable expandable structure 1.

Rubber gaskets 33 are mounted on all edges of the stationary module 2 which are connected to the slide-out modules 3, and rubber gaskets 34 are mounted on all edges of rear parts of each slide-out module 3 which are connected to the stationary module 2, while rollers 35 of the stationary module 2 and rollers 36 of the corresponding slide-out modules 3 are mounted between said rubber gaskets 33, 34.

The transportable expandable structure 1 comprises an expandable roof 48 that comprises a stationary part 49 and movable expandable parts 50. The stationary part 49 of the roof is mounted and rigidly fixed above the ceiling of the stationary module 2, while the expandable parts 50 of the roof are mounted and rigidly fixed above the ceilings of the movable modules 3. Cavities for receiving the expandable parts 50 of the roof are formed under the stationary part 49 of the roof and above the ceiling of the stationary module 2, while openings for providing free movement of the movable expandable parts 50 of the roof outwardly and inwardly under the stationary part 49 of the roof are arranged on either side of the stationary part 49 of the roof. The expandable parts 50 of the roof are formed of a frame base 59, while upper horizontal planes 53, vertical front and rear plates 54 and vertical lateral planes 55 are attached to the frame base. Guiding elements 51 for the expandable parts 50 of the roof are mounted on an internal horizontal plane of the stationary part 49 of the roof perpendicularly to a length of the stationary part 49 of the roof, and profile elements 52 corresponding to the guiding elements 51 are mounted on the upper horizontal planes 53 of the expandable parts of the roof. Vertical tubes 56 are attached to the frame base 59 on lateral edges of the expandable parts 50 in the area of the vertical planes 55, while internal bars 57 are mounted inside the vertical tubes in a vertically movable fashion, and upper ends of the bars are connected to the edges of the corresponding upper horizontal planes 53 of the corresponding expandable parts 50 of the roof, and planar vertical flaps 58 are connected to external edges of the upper horizontal planes 53, while the flaps are movable in connection points and are horizontally arranged along the corresponding lateral vertical planes 55 along the entire length of each lateral side of each corresponding expandable part 50 of the roof.

BRIEF DESCRIPTION OF THE DRAWINGS

Practical implementation and industrial applicability of the transportable expandable structure will be explained by schematic views of the structure, where.

NOMENCLATURE, LIST OF ELEMENTS, ASSEMBLIES, DETAILS OF THE INVENTIVE STRUCTURE

Figure 1:
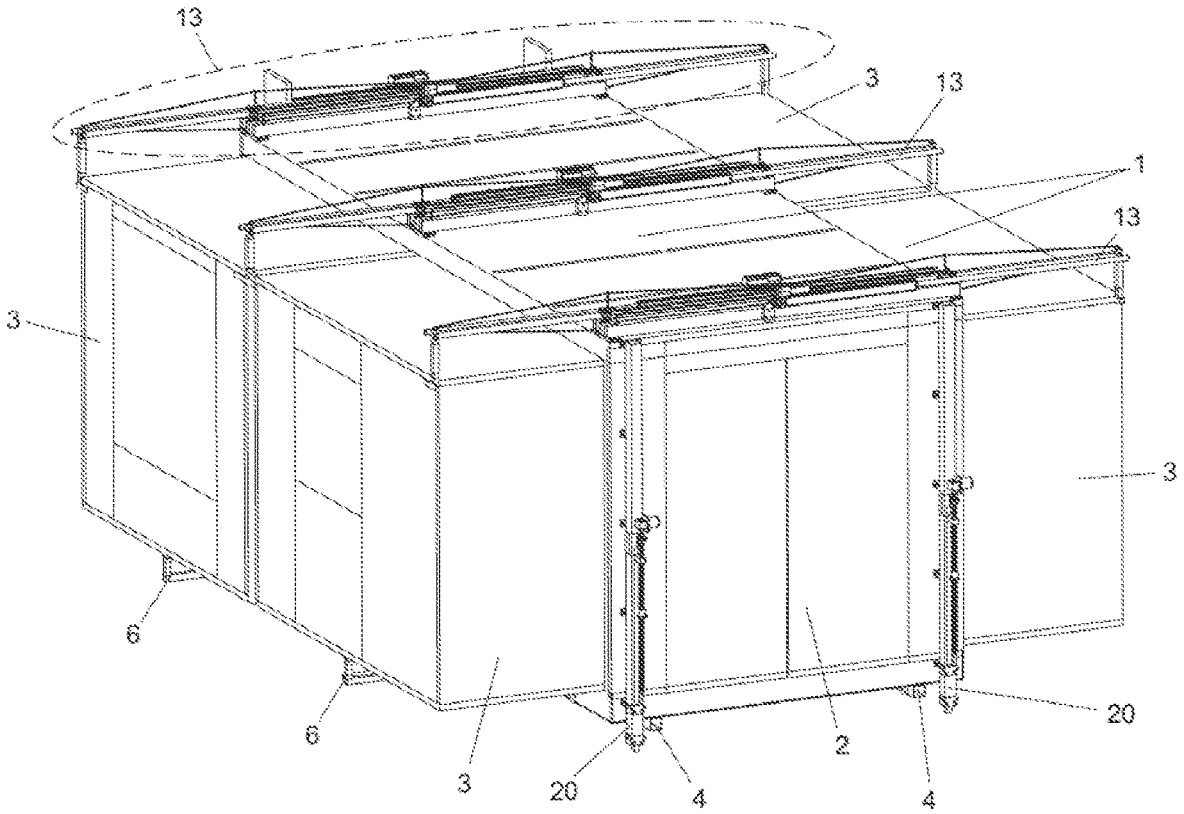
FIG. 1 illustrates the expanded structure 1, four slide-out modules 3 which are slid-out from the stationary module 2.

1—the transportable expandable structure;
2—the stationary module;
3—the slide-out modules;
4—the frame;
5—the trusses of the frame 4;
6—the expansion mechanisms for the slide-out modules 3;
7—the stationary guiding tie (external tube) of the expansion mechanism 6;
8—the internal movable push-out tube of the expansion mechanism 6;
9—the rollers of the expansion mechanism 6;
10—the linear motors of the expansion mechanisms 6;
11—the magnets of the motors 10 and of the motors 44;
12—the magnetic sensors of the expansion mechanisms 6 and of the support mechanisms 13;
13—the support mechanisms for supporting the slide-out modules 3;
14—the stationary U-shaped profile beams of the support mechanism 13;
15—the internal movable push-out tube of the support mechanism 13;
16—the external roller systems of the support mechanism 13;
17—the masts of the support mechanism 13;
18—the ropes of the support mechanism 13;
19—the openings of the masts 17;
20—the lifting mechanisms;
21—the external stationary tube of the lifting mechanism 20;

22—the internal movable tube of the lifting mechanism 20;
23—the rollers of the lifting mechanism 20;
24—the slit of the external stationary tube 21;
25—the linear motors of the lifting mechanisms 20;
26—the ball screw pair of the lifting mechanism 20;
27—the reduction gear of the lifting mechanism 20;
28—the weight sensors of the lifting mechanisms 20;
29—the controller-based control unit;
30—the box structure for the rigid tubes 31 and for the flexible hoses 32;
31—the rigid tubes of the heating and/or water supply-sewerage systems;
32—the flexible hoses of the heating and/or water supply-sewerage systems;
33—the rubber gaskets of the stationary module 2;
34—the rubber gaskets of the slide-out modules 3;
35—the rollers of the stationary module 2;
36—the rollers of the slide-out modules 3;
37—the additional U-shaped stationary profile beams of the support mechanism 13;
38—the fixing upper U-shaped profiles of the stationary profile beams 14 and of the additional U-shaped stationary profile beams of the support mechanism 13;
39—the internal rollers mounted at the end point of the support mechanism 13;
40—the "vertical" internal rollers mounted at the start point of the support mechanism 13
41—the "horizontal" internal rollers mounted at the start point of the support mechanism
13;
42—the bracket at the internal movable push-out tube 15 for fixing the slide-out module;
43—the additional profile elements/tubes of the support mechanism 13;
44—the linear motors of the support mechanisms 13;
45—the rods of the linear motors 44 of the support mechanisms 13;
46—the casings for the rods 45;
47—the mounting brackets for mounting the linear motors 44;
48—the expandable roof;
49—the stationary part of the expandable roof 48 for the stationary module 2;
50—the expandable parts of the expandable roof 48 for the movable modules 3;
51—the guiding elements 51 of the stationary part 49 of the expandable roof 48;
52—the profile elements 52 (corresponding to the guiding elements 51) of the expandable parts 50 of the expandable roof 48;
53—the upper horizontal planes of the expandable parts 50 of the expandable roof 48;
54, 55—the vertical planes of the expandable parts 50 of the expandable roof 48;
56—the vertical tubes of the expandable parts 50 of the expandable roof 48;
57—the internal bars 57 mounted inside the vertical tubes 56;
58—the flaps of the expandable parts 50 of the expandable roof 48;
59—the frame base of the expandable parts 50 of the roof 48;
60—the position sensor for determining positions of the lifting mechanisms 20.

DETAILED DESCRIPTION OF THE PREFERRED EMBODIMENT

The transportable expandable structure 1 is designed in such a way that the stationary module 2 represents its base, while the slide-out modules 3 are accommodated inside the stationary module. This state of the structure 1 is intended for transportation and storage. It is not allowed to use the structure 1, if the modules 3 are retracted. In order to enable a full-scale usage, the slide-out modules 3 must be slid-out from the stationary module 2. In the best exemplary embodiment of the invention, the structure 1 comprises four slide-out modules 3 which are arranged pairwise on two opposite sides of the stationary module 2 (however, only two slide-out modules 3 may be provided).

In order to enable an automated control of the operation of electronic, mechanical and other systems of the structure 1, the invention provides that the structure 1 comprises the control unit 29 having the controller, software and wireless communication means which are configured to exchange control signals and other signals, data, information with modern personal electronic digital user devices (phone, smartphone, computer, laptop etc.).

The structure 1 is designed in such a way that the paired slide-out modules 3 slide out towards two opposite directions from an interior of the stationary module 2. One of problems that usually exists in case of these structural dimensions lies in that it is not possible to achieve uniform and stable smooth movement during sliding-out/retraction of the modules 3 outwardly from or inside the module 2. In other words, jamming, imbalances, gaps, unexpected stoppages of one or more modules 3 usually arise during this movement, thereby causing an imbalance of the modules 3, an excessive load onto certain mechanical elements, their possible damage and incorrect operation. In order to resolve this problem, the invention provides the following structural solutions.

1. The rigid frame 4 with the trusses 5 is mounted in the lower part of the structure 1, the trusses are stationary and immovable elements, and the stationary module 2 with the slide-out modules 3 is mounted on the trusses. Besides, the frame 4 with the trusses 5 is a rigid and stable base which is suitable for integrating the expansion mechanisms 6 with the linear motors 10 therein, and the motors are drives of the slide-out modules 3 in the lower part of the structure 1.

2. The support mechanisms 13 with the linear motors 14 are mounted in the upper part of the structure 1. The support mechanisms 13, besides supporting the slide-out modules 3, also act as "drives" for the slide-out modules 3 in the upper part of the structure 1.

3. If four slide-out modules 3 are used in the structure 1, then four expansion mechanisms 6 will be integrated in the frame 4, and the expansion mechanisms are mounted pairwise, where one expansion mechanism 6 of the pair operates (moves) in one direction from the stationary module 2, while another expansion mechanism 6 operates (moves) in the opposite direction from the stationary module 2. Each expansion mechanism 6 is mounted in the lower part under the floor of the stationary module 2 between sections of the stationary frame 4 and is arranged horizontally in width and transversely to the stationary module 2. Each two paired slide-out modules 3 are rigidly bound together. Therefore, one expansion mechanism 6 is intended for and connected to each of the slide-out modules 3. It shall be understood that timely and precise operation of all the expansion mechanisms 6 is required during sliding-out/retraction of the modules 3. Also, if four slide-out modules 3 are used in the structure 1, then three pairs of the support mechanisms 13 are used in the upper part of the structure 1 horizontally in width and transversely to the stationary module 2, the support mechanisms are mounted in such a way that one paired support mechanism 13 is arranged at the center of the structure 1, while two other paired support mechanisms 13 are arranged at the edges along the front part and the rear part of the structure 1, and, accordingly, each bound pair of the slide-out modules 3 is connected to the three support mechanisms 13 in the upper part. Each of the three pairs of the support mechanisms 13 comprises two internal movable push-out tubes 15 and at least four stationary U-shaped profile beams 14 which are arranged and made in such a way that the two internal movable push-out tubes 15 move and push-out/retract in opposite directions, while all the stationary U-shaped profile beams 14 remain stationary (they are rigidly attached to the ceiling of the stationary module 2). The push-out tubes 15 are connected to the rods 45 of the linear motors 44 which, in turn, are connected to the control unit 29. Each linear motor 44 is attached to one of the corresponding stationary U-shaped profile beams 14 of the corresponding support mechanism 13. The movable push-out tubes 15 are bound to the slide-out modules 3. It shall be understood that timely and precise operation of all the support mechanisms 13 is required during sliding-out/retraction of the modules 3.

4. Each expansion mechanism 6 is the "tube in a tube" system, where the external tube is the stationary guiding tie 7 (that is rigidly attached to the stationary frame 4 in the lower part of the stationary module 2), while the internal movable push-out tube 8 is the movable push-out element, and this internal movable push-out tube 8 is rigidly attached to the lower horizontal plane of the corresponding slide-out module 3. The rollers 9 are mounted between the walls of the stationary guiding tie 7 and the walls of the internal movable push-out tube 8 (the rollers facilitate easy movements of the internal movable push-out tubes 8 in the stationary guiding ties 7). It should be noted that the rollers 9 in the expansion mechanisms 6 not only facilitate the movements of the internal movable push-out tubes 8 in the stationary guiding ties 7, but also act as "space fillers" between the walls of the internal movable push-out tubes 8 in the stationary guiding ties 7, thereby further minimizing the probability of arising of gaps, imbalances and jamming of the elements of the expansion mechanisms 6 during their operation. In order to enable creation of the mechanical movement, each expansion mechanism 6 comprises the linear motor 10 that is mounted adjacent to the corresponding stationary guiding tie 7, and the rod of each of the linear motors 10 is rigidly connected to the corresponding internal movable push-out tube 8 in order to provide the tube with a mechanical horizontal movement. It shall be understood that if four expansion mechanisms 6 are provided, then four linear motors 10 will be used for the four slide-out modules 3. All the linear motors 10 of all of the expansion mechanisms 6 are connected to the control unit 29.

6. All the expansion mechanisms 6 and their linear motors 10 are synchronized between each other. The synchronization of the linear motors 10 may be implemented by various means. The following synchronization structure and system is proposed according to claim 2 of the claimed invention. A magnet 11 is mounted on the rod of each linear motor 10 of each of the expansion mechanisms 6, and magnetic sensors 12 are mounted on an outer casing of each of these linear motors 10, the magnetic sensors form "check points" for transmitting, to the control unit 29, certain signals about certain positions of the linear motors 10 and of the internal movable push-out tubes 8 which the slide-out modules 3 are attached to. This synchronization enables the internal movable push-out tubes 8 to move together with the slide-out modules 3 in a maximum controlled fashion. Detailed description of this synchronization operation is provided hereinafter in the section "Practical implementation and industrial applicability of the transportable expandable structure".

7. All the support mechanisms 13 and their linear motors 44 are also synchronized between each other (the synchronization of the linear motors 44 may be implemented in the same way as in the linear motors 10 of the expansion mechanisms 6 by means of the same magnets 11 and magnetic sensors 12). Besides, all the support mechanisms 13 and their linear motors 44 are synchronized with the expansion mechanisms 6 and with their linear motors 10.

In general, the synchronization of the operation of the linear motors 10 enables timely stop or start of the movement of the internal movable push-out tubes 8 together with the slide-out modules 3 in the lower part of the structure 1, and the synchronization of the operation of the linear motors 44 enables timely stop or start of the movement of the internal movable push-out tubes 15 together with the slide-out modules 3 in the upper part of the structure 1. Thus, the synchronized operation of the expansion mechanisms 6 and their linear motors 10 (at the bottom) as well as the support mechanisms 13 and their linear motors 44 (at the top) in combination with the controlled operation of the control unit 29 avoids unexpected imbalances of the slide-out modules 3 (due to their different positions relative to the stationary module 2 that acts as a gravity and load center), avoids unexpected jamming (due to imbalances) and avoids unplanned stoppages of the slide-out modules 3 during their movements.

Therefore, the provision and the structural features of the reinforced metal frame 4 having the trusses 5, of the expansion mechanisms 6 which are formed by the external stationary guiding tie 7 and the internal movable push-out tube 8, the rollers 9, the linear motors 10 which are synchronized and controlled by the control unit 29 having the controller and software, the provision and the structural features of the support mechanisms 13 which are formed by the stationary U-shaped profile beams 14, the internal movable push-out tubes 15, the sets of rollers 40, 41, 16, 39, the linear motors 44 which are synchronized and controlled by the control unit 29, enable to achieve stable, uniform, smooth, mechanized and automated simultaneous slide-out of several slide-out modules 3 outwardly from the stationary module 2 as well as to achieve stable, uniform, smooth, mechanized and automated simultaneous retraction of several slide-out modules 3 inside the stationary module 2.

Besides, the combination of the reinforced metal frame 4 having the trusses 5, while the expansion mechanisms 6 are integrated in the frame, where the external stationary guiding ties 7 are rigidly attached to the frame 4, while the internal movable push-out tubes 8 are rigidly attached to the lower parts (to the floors) of the slide-out modules 3 in combination with the fact that the slide-out modules 3 are rigidly bound pairwise together, enables stable and rigid support of the slid-out slide-out modules 3 at the bottom even without any lower supports.

Another problem that arises in similar devices is instable and shaky support of the slide-out modules 3 at the top, when they move in any direction and when they are already slid-out and used. Functionally, the slide-out modules 3 are rooms which are intended to accommodate people, equipment, furniture and other items, thus, reliability and stability of their spatial stationary "suspended" position cannot be left underestimated. In order to hold the slide-out modules, most of known similar devices utilize lower supports or very heavy and complex hydraulic, mechanical and other devices which, from one hand, complicate and aggravate the entire structure, while, from another hand, do not provide maximum stability and safety of holding of the slide-out modules 3. Also, such solutions do not enable to retract/slide out the slide-out modules 3 as quickly and simply as possible.

In order to resolve this problem, the claimed invention provides the following solution:

1. Each of the support mechanisms 13 is formed by at least three profile elements, namely, by two stationary U-shaped profile beams 14 with the internal movable push-out tube 15 that is movably mounted between them. Therewith, each of the support mechanisms 13 is mounted in the upper part of the structure 1 horizontally in width and transversely to the stationary module 2 in such a way that the stationary U-shaped profile beams 14 of the support mechanisms 13 are rigidly attached to a horizontal plane of the ceiling of the stationary module 2, and the internal movable push-out tubes 15 are rigidly attached to vertical planes of the ceilings of the corresponding slide-out modules 3 by means of the brackets 42, while at the same time, the internal movable push-out tubes 15 are rigidly bound to the rods 45 of the linear motors 44 by means of the brackets 42.

2. In order to provide easy and reliable movement of the internal movable push-out tubes 15 (together with the slide-out modules 3), each of the support mechanisms 13, between the stationary U-shaped profile beams 14, comprises the first set of rollers 40, 41 (at least two rollers 40 and two rollers 41) that is mounted at the start point of the support mechanism 13 and the second set of rollers 16 (two roller sets), 39 (two rollers) which are mounted at the end point of the support mechanism 13. The sets of rollers are mounted and arranged relative to the elements of the support mechanism 13 in such a way that they avoid harmful oscillations, gaps and imbalances of the internal movable push-out tubes 15 between the stationary U-shaped profile beams 14 both horizontally and vertically, both at the start point of the support mechanism 13 and at its end point (it is described in more detail in the section "Practical implementation and industrial applicability of the transportable expandable structure"). Therefore, the structural set of the stationary U-shaped profile beams 14 with the internal movable push-out tube 15 (that is attached to the corresponding rod 45 of the corresponding linear motor 44) movably mounted between them as well as said sets of rollers 40, 41, 16, 39 together with the described structure and the operation of the metal frame 4 system with the expansion mechanisms 6 with the linear motors 10 integrated therein enable to enhance stability, uniformity, smoothness of the mechanized and automated simultaneous sliding-out of several slide-out modules 3 outwardly from the stationary module 2 as well as to enhance stability, uniformity, smoothness of the mechanized and automated simultaneous retraction of several slide-out modules 3 inside the stationary module 2. In other words, when the expansion mechanisms 6 with the linear motors 10 form the synchronized movement of the slide-out modules 3 in the lower part of the structure 1, and the support mechanisms 13 with the linear motors 14 form the synchronized movement of the slide-out modules 3 in the upper part of the structure 1, the combination of details and elements of the expansion mechanisms 6 and the support mechanisms 13 (in the form of combination of ties, movable tubes, beams, rollers), their number, mutual arrangement, mounting location in the structure 1 provide a maximum facilitation of easy and stable movement of the slide-out modules 3 in both upper and lower parts of the structure 1.

3. Each of the support mechanisms 13 comprises at least two vertical masts 17 that are oppositely mounted on the internal movable push-out tubes 15, while two reinforcing ropes 18 extending through openings 19 of the masts 17 along the entire corresponding internal movable push-out tube 15 at a top and at a bottom, and ends of the ropes are fixed at ends of this internal movable push-out tube 15. The ropes 18 create a compensatory load both at the top and at the bottom acting onto the horizontal movable internal push-out tube 15. Owing to this mutual compensatory load, the two ropes 18 provide a minimum possibility of buckling of the internal movable push-out tube 15 under the weight of the slide-out modules 3, when this tube 15 is pushed out outwardly from the stationary module 2. Unexpected effect of this structural solution is that when the overall weight of each of the support mechanisms 13 together with the two ropes 18 is about 30 kg, the weight of the slide-out module 3 at each of the ends of the internal movable push-out tube 15 of one support mechanism 13 will be up to about 250 kg. Thus, when the support mechanisms 13 have a relatively low weight, their structural features in combination with the ropes 18 enable to provide a significantly high reliability as to holding the expanded slide-out modules 3 in the "suspended" state (without use of lower vertical supports) during any time period that is necessary for usage of the structure 1.

As mentioned above, if four slide-out modules 3 are used, then three pairs of the support mechanisms 13 are mounted in the upper part of the structure 1, and the support mechanisms in this case comprise totally six movable push-out tubes 15 with six linear motors 44, where the movable push-out tubes 15 are attached to the slide-out modules 3. The reinforcement of the structures of the support mechanisms 13 may be achieved by using additional details, namely, the additional U-shaped stationary profile beam 37 is mounted adjacent and parallel to each of the stationary U-shaped profile beams 14, and the beams 14 and 37 mounted in parallel are bound by the upper U-shaped profile element 38 in their upper parts along the entire length. It should be also noted that the stationary U-shaped profile beams 14 of the pairs of the support mechanisms 13, the beams are arranged adjacent and parallel in their upper parts, also may be bound together by the upper U-shaped profile element 38 along the entire length. Besides, in order to provide rigidity and convenience of attachment of the support mechanisms 13 to the upper part of the structure 1 (to the stationary module 2 and to the slide-out modules 3), the stationary U-shaped profile beams 14, 37 in the structure of the support mechanism 13 are mounted and secured on additional profile elements/tubes 43 which the mentioned attachment and connection may be performed through.

Therefore, the structure and arrangement of the support mechanisms 13 fully provide stable and long-term support of the slid-out slide-out modules 3 at the top even without any lower additional vertical supports.

In separate embodiments of the transportable expandable structure 1, it may comprise support brackets or supporting and fastening elements for providing a horizontal mounting or mounting and fastening on a trailer or on a cargo bay of a vehicle. Also, the transportable expandable structure 1 may comprise a wheeled chassis that is arranged in the lower part of the stationary module 2.

Said solutions are rather common and in these cases, when the device comprises, e.g., only support brackets for mounting on a horizontal surface, it will be required to use additional means for loading/unloading of the structure 1 which is not convenient and complicates the transportation and usage process thereof.

In separate embodiments of the invention, the transportable expandable structure 1 may comprise the expandable roof 48 that is formed by the stationary part 49 and the movable expandable/retractable parts 50. The stationary part 49 of the roof is mounted in the upper part of the stationary module 2, while the expandable parts 50 of the roof are mounted in the upper parts of the movable modules 3. The expandable roof 48 is structured in such a way that the expandable parts 50 of the roof, when the structure 1 is in its folded position, are arranged under the stationary part 49 of the roof, while during the expansion, these expandable parts 50 of the roof move and expand outwardly together with the corresponding slide-out modules 3. This is enabled due to: provision of cavities (not indicated by numerical positions and not depicted in the figures) between the ceiling of the stationary module 2 and the stationary part 49 of the roof, provision of openings (not indicated by numerical positions and not depicted in the figures) on either side of the stationary part 49 of the roof; provision of the guiding elements 51 which are mounted on the internal horizontal plane of the stationary part 49 of the roof and provision of the profile elements 52 (corresponding to the guiding elements 51) which are mounted in the upper horizontal planes 53 of the expandable parts 50 of the roof.

The upper horizontal planes of the stationary part 49 of the roof and of the expandable parts 50 of the roof are made slightly rounded in order to allow a free drain of natural liquids (rain, snow) down from the expandable roof 48. With this configuration of the expandable roof 48, when the slide-out modules 3 slide out together with the expandable parts 50 of the roof, the edges of the upper horizontal planes 53 of the expandable parts 50 of the roof slightly descend downwards (owing to the rounded shape of the upper planes of the stationary parts 49 and of the expandable parts 50). And after the expandable parts 50 of the roof are retracted under the stationary part 49 of the roof, the same edges of the upper horizontal planes 53 slightly lift upwards also owing to the rounded shape of the upper planes of the stationary parts 49 and of the expandable parts 50, and in view of this, horizontal slots are formed in the area of the edges of the upper horizontal planes 53 of the expandable parts 50 of the roof, and air may enter inside the structure 1 through the slits from outside, thereby negatively affecting thermal insulation characteristics of the structure 1. In order to resolve this problem, that is, in order to cover this slit, special original structural parts and details which will be described hereinafter are provided and mounted in the structure of the expandable roof 48. As mentioned earlier, the expandable parts 50 of the roof are formed of the frame base 59, while the upper horizontal planes 53, the vertical front and rear plates 54 and the vertical lateral planes 55 are attached to the frame base. At the side edges of the expandable parts 50 (in the area of the vertical planes 55), the vertical tubes 56 are attached to the frame base 59, and the internal bars 57 are mounted inside the vertical tubes in a vertically movable fashion, while the upper parts of the internal bars are connected to the edges of the corresponding upper horizontal planes 53 of the corresponding expandable parts 50 of the roof. At moments, when the expandable parts 50 of the roof slide out, the edges of the upper horizontal planes 53 will slightly descend downwards and, thus, the upper horizontal planes 53, by their own movement, push the internal bars 57 attached thereto in the openings of the vertical tubes 56 downwards as well. While when the expandable parts 50 of the roof expand, the edges of the upper horizontal planes 53 will slightly lift upwards and pull the internal bars 57 therewith in the openings of the vertical tubes 56 upwards. The planar vertical flaps 58—"curtains"—are attached to the external edges of the upper horizontal planes 53 in a non-rigid fashion (in a movable fashion in the attachment points), the flaps are arranged in the entire length along the corresponding side vertical planes 55 on either side of the corresponding expandable parts 50 of the roof. During retraction of the expandable parts 50 of the roof, when the edges of the upper horizontal planes 53 slightly lift upwards and the horizontal slit is formed in the area of the edges of the upper horizontal plane 53 of the expandable parts 50 of the roof, the horizontal planes 53 will pull the internal bars 57 in the openings of the vertical tubes 56 upwards together with the flaps 58 in such a way that these flaps 58 as "curtains" cover the formed slits. At moments, when the expandable parts 50 of the roof are slid-out, there will be no slit, and the flaps 58 will slightly descend downwards and vertically suspend over the side vertical planes 55 of the expandable parts 50 of the roof. This solution enables to improve the thermal insulation of the structure 1.

Functionally, use of the expandable roof 48 enables to cover the complex support mechanisms 13 for supporting the slide-out modules 3 (both in the retracted position and in the expanded position) at the top and on either side, and to protect all the elements and details of the support mechanisms 13 against environmental exposure (snow, rain, wind, humidity and other factors).

In separate embodiments of the structure, the invention provides use of at least four lifting vertical mechanisms 20 which may be vertically mounted at least in corners of the stationary modules 2 and/or one lifting mechanism 20 for the slide-out modules 3. The elements of the lifting mechanisms 20 are movable vertically upwards/downwards. Each lifting mechanism 20 is the "tube in a tube" system (having the internal rollers 23), the system is formed by the external stationary tube 21 and by the internal movable tube 22. The rollers 23 are mounted between the walls of the external stationary tube 21 and the walls of the internal movable tube 22. Each of the external stationary tubes 21 is rigidly attached to the corresponding module, while each of the internal movable tubes 22 is mounted so as to be movable vertically upwards/downwards relative to the corresponding external stationary tube 21 and relative to the specific module which this external stationary tube 21 is attached to. Each of the lifting mechanisms 20 comprises its own linear motor 25, reduction gear 27 and ball screw pair 26 which together form the motion transmission assembly for transmitting the motion upwards/downwards from the linear motor 25 to the internal movable tube 22. All the linear motors 25 are connected to the control unit 29. In order to enable horizontal alignment of the structure 1 and its modules, the lifting mechanisms 20 may comprise the weight sensors 28 and the position sensors 60, while tilt sensors may be mounted in the stationary module 2 (e.g., in the floor). Said weight sensors 28, position sensors 60, tilt sensors are electronically connected to the control unit 29.

Use of the lifting mechanisms 20 enables the user, by means of his/her own electronic digital device (smartphone, phone, laptop), to transmit, via the control unit 29, commands to lift or descend the lifting mechanisms 20 (which rely on a horizontal base, i.e., soil, concrete, asphalt or another one) and, thus, to lift or descend the entire structure 1 relative to the trailer or relative to the cargo bay of the car, thereby, in turn, allowing the vehicle to quickly go out from under the structure 1 or to drive in under the structure. Therefore, an additional technical effect is achieved that lies in providing convenient and quick loading/unloading of the structure to/from trailers and to/from vehicle cargo bays with no additional mechanisms involved.

The provision of the lifting mechanisms 20, the weight sensors 28 and the position sensors 60, and/or the provision of the tilt sensors (not indicated by numerical positions and not depicted in the figures) in the stationary module 2, and the provision of the electrical connection between these sensors and the control unit 29 enhance the ability of performing the automated and mechanized horizontal alignment of the structure, when it is mounted on rough surfaces (soil, grass surface, stony surface, sand surface etc.). Said weight sensors 28 and position sensors, and/or tilt sensors, provide the control unit 29 with certain signals about spatial positions of each of the four lifting mechanisms 20 (at least the ones taken vertically) and, thus, this data combination provides the control unit 29 with information about spatial positions of the stationary module 2 and of the structure 1 relative to the horizontal and to the vertical at least in four points (where the lifting mechanisms 20 or the tilt sensors are located), thereby enabling the control unit 29 to control the operation of the linear motors 25 in order to align the position of the stationary module 2 and of the entire structure 1 relative to the horizon.

It should be noted that when several lifting mechanisms 20 are provided, the user also will be able to control their height (by controlling the operation of the linear motors 25 via the control unit 29) in order to align the structure 1 horizontally even without said sensors, but, e.g., using known individual devices for controlling the horizon line (construction, electronic, laser and other devices).

The transportable expandable structure 1 and its modules 2, 3 are designed in such a way that their structure enables to mount and to use various life support systems, namely, a ventilation system and/or a heating system and/or a water supply-sewerage system and/or a thermal insulation system and/or a noise insulation.

Considering the characteristic features of the connections between the stationary module 2 and the slide-out modules 3, individual embodiments of the invention provide improvements of the communications which may relate to the water supply and/or heating systems. The box structure 30 may be mounted under the floor and the bottom of the stationary module 2, and the rigid tubes 31 which are interconnected by the flexible hoses 32 (for providing water supply and/or heat supply to the slide-out modules 3) are accommodated inside the box structure. The interconnected rigid tubes 31 and the flexible hoses 32 are connected to other water supply and/or heat supply means which are arranged in the stationary module 2 and in the slide-out modules 3. During movements of the slide-out modules 3, the flexible hoses 32 also may move (unwind) inside the box structure 30 without breaking the connections of the rigid tubes 31 and other water supply/heat supply communication hoses. This solution improves the operational conditions of the structure 1 at moments when its useful area is increased as much as possible (when the slide-out modules 3 are slid-out outwardly).

In order to increase the level of the thermal insulation and the sealing of the stationary module 2 and of the slide-out modules 3, the invention provides that the rubber gaskets 33 may be mounted on all of the edges of the stationary module 2 which are connected to the slide-out modules 3 (i.e., the rubber gaskets 33 are mounted along the entire perimeter of each of the "open parts" of the stationary module 2). Also, the rubber gaskets 34 are also mounted on all of the edges of the rear parts of each of the slide-out modules 3 which are connected to the stationary module 2 (i.e., the rubber gaskets 34 are mounted along the entire perimeter of the rear part of each of the slide-out modules 3). The rollers 35 of the stationary module 2 and the rollers 36 of the corresponding slide-out modules 3 are mounted between these rubber gaskets 33, 34. When the slide-out modules 3 are completely slid-out, the rubber gaskets 33 of the stationary module 2 and the rubber gaskets 34 of the slide-out modules 3 will shift and "duplicate" in slit locations of the modules and form doubled rubber seals in these locations. This solution also enhances the operational conditions of the structure 1 in terms of achievement of the maximum thermal insulation and sealing, when its useful area is increased as much as possible (i.e., when the slide-out modules 3 are slid-out outwardly), and thermal insulation plates or polyisocyanurate (of a PIR type) plates may be used as the thermal insulation elements for the walls, the ceilings and other elements of the stationary module 2 and/or of the slide-out modules 3, while the vacuum glass may be used for windows and for other transparent elements of the transportable expandable structure 1.

In general, the original structural features, mounting locations, mutual connections and arrangements of the main elements of the invention such as: the stationary module 2, the at least two slide-out modules 3, several expansion mechanisms 6 with the synchronized linear motors 10 which are integrated in the frame 4 in the lower part of the structure 1, several support mechanisms 13 with the linear motors 44 and with the ropes 18 in the upper part of the structure 1, the control unit 29 with the controller, software and wireless communication means that is connected to the elements for controlling the movements of the expansion mechanisms 6 as well as to all of the electronic elements of the structure 1, enable to create the transportable expandable structure that is able to increase its own living space and the useful area as much as possible quickly, easily, reliably and in the mechanized and automated fashion (for example, when each of the four slide-out modules 3 is slid-out by 115 cm-120 cm outwardly, the useful area of the structure 1 will be further increased by about 13 $m^2$, i.e., from 13 $m^2$ (in the folded state) up to about 26 $m^2$ (in the slide-out state)).

The overall dimensions of the structure 1 in the folded state may be as follows: width is about 2.5 m, length is about 5.7 m, height is about 2 m. In the slid-out (unfolded) state they are as follows: width is about 4.68 m, length is about 5.7 m, height is about 2 m.

Therefore, the claimed structure 1 allows to achieve all the mentioned main technical effects owing to the set of all the essential features which are stated in the first claim.

Further possible features and characteristics of the invention are provided in additional claims, and their use allows to achieve additional technical effects.

Description of the Structure and Elements Thereof

The transportable expandable structure 1 comprises the door opening (not indicated by a numerical position). Preferably, the stationary module 2 of the structure 1 is box-shaped and may comprise external and internal doors (not indicated by numerical positions), windows, and it comprises a base in the form of the frame 4 with the trusses 5 which are arranged in the lower part of the structure 1 (FIG. 1-FIG. 4). The frame 4 and the trusses 5 are stationary and immovable elements. The stationary module 2 is mounted and secured on the stationary frame 4 with the trusses 5, the stationary module comprises at least the floor, two opposite walls, the ceiling and at least one door opening (not indicated by numerical positions).

The slide-out modules 3 are mounted inside the stationary module 2 (FIG. 1, 2, 16, 17). There could be at least two slide-out modules 3 or more, for example, four slide-out modules (two on either side of the stationary module 2). Each of the slide-out modules 3 comprises its own floor, at least three walls and ceiling. Each of the slide-out modules 3 may comprise external and internal doors, windows. The slide-out modules 3 are movable and slidable-out in width outwardly from the structure from the stationary module 2. In some embodiments of the invention, each two slide-out modules 3 of each of the pair (on either side of the structure) are rigidly connected to each other. The slide-out modules 3 move outwardly from or inside the stationary module 2 by means of the expansion mechanisms 6, the linear motors 10 and the support mechanisms 13.

The transportable expandable structure 1 comprises elements for connecting the slide-out modules 3 to the stationary module 2. According to the invention, these connection elements are represented by a set of the expansion mechanisms 6 with the linear motors 10 in the lower part of the structure 1 and by several support mechanisms 13 with the ropes 18 which are mounted in the upper part of the structure 1.

Figure 3:
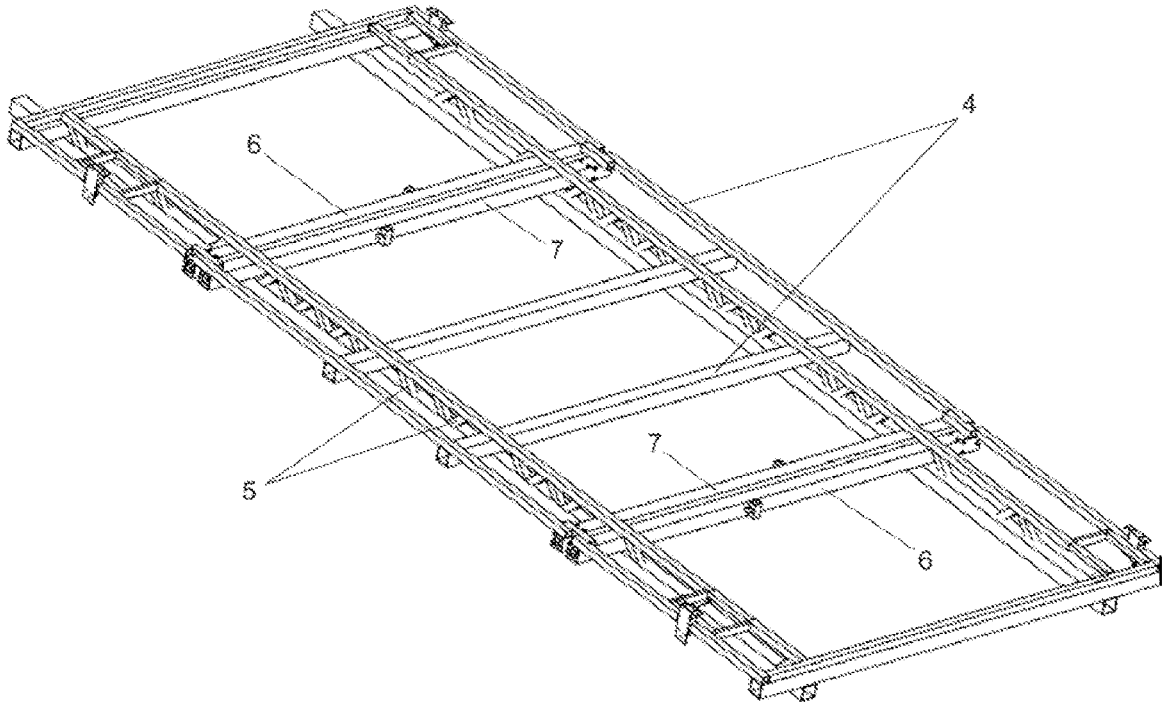
FIG. 3 illustrates the frame 4, the trusses 5 and the expansion mechanisms 6 in the retracted state.

The expansion mechanisms (FIG. 3, 4, 6).

Each of the expansion mechanisms 6 is arranged in the lower part of the stationary module 2 between sections of the stationary frame 4 under the floor of the stationary module 2, where each of the expansion mechanism 6 is mounted horizontally in width and transversely to the stationary module 2. In order to provide sliding-out/retraction of one slide-out module 3, e.g., one expansion mechanism 6 may be used, but without limitation thereto. If the structure 1 utilizes, e.g., two slide-out modules 3 towards each side (four slide-out modules 3 in total), then, accordingly, four expansion mechanisms 6 will be mounted in the stationary frame 4, but without limitation thereto.

Figure 6:
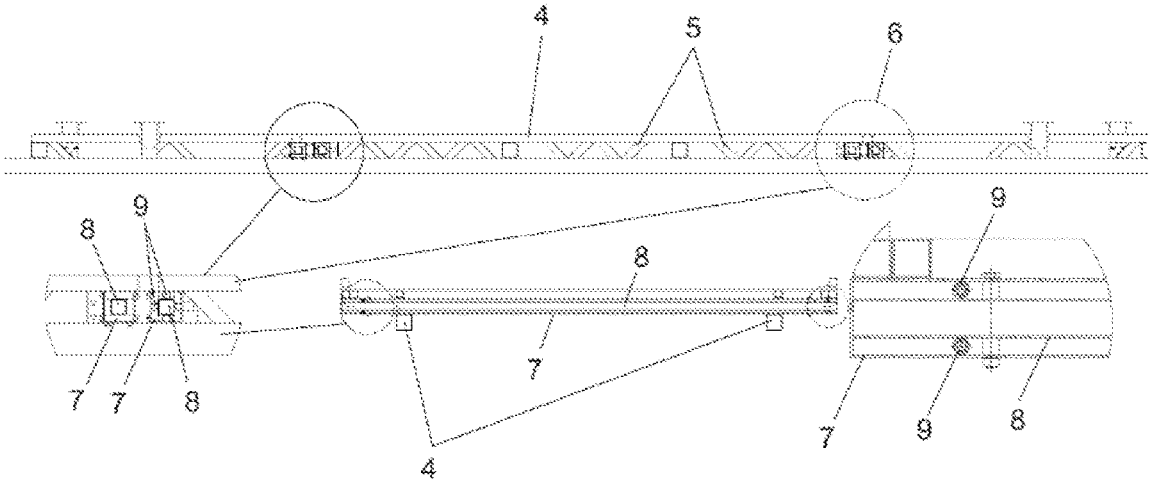
FIG. 6 illustrates the elements of the expansion mechanism 6 and the rollers 9.

Each of the expansion mechanisms 6 is the "tube in a tube" system, where the external tube is the stationary guiding tie 7, while the internal push-out tube 8 is the movable push-out element (FIG. 3, 4). Also, each of the expansion mechanisms 6 comprises the set of internal rollers 9 (FIG. 6). The rollers 9 are mounted between the walls of the stationary guiding tie 7 and the walls of the internal movable push-out tube 8. The rollers 9 facilitate the horizontal movement of the "tube in a tube" as well as press the internal movable push-out tube 8 in the external tube inside the stationary guiding tie 7 in order to avoid occurrence of any gaps and imbalances during the movements. The stationary guiding ties 7 of all of the expansion mechanisms 6 are rigidly attached to the trusses 5 of the stationary frame 4 in the lower part of the stationary module 2. The internal movable push-out tubes 8 of the expansion mechanisms 6 are connected to the lower horizontal planes (not indicated by numerical positions) of the corresponding slide-out modules 3.

Figure 4:
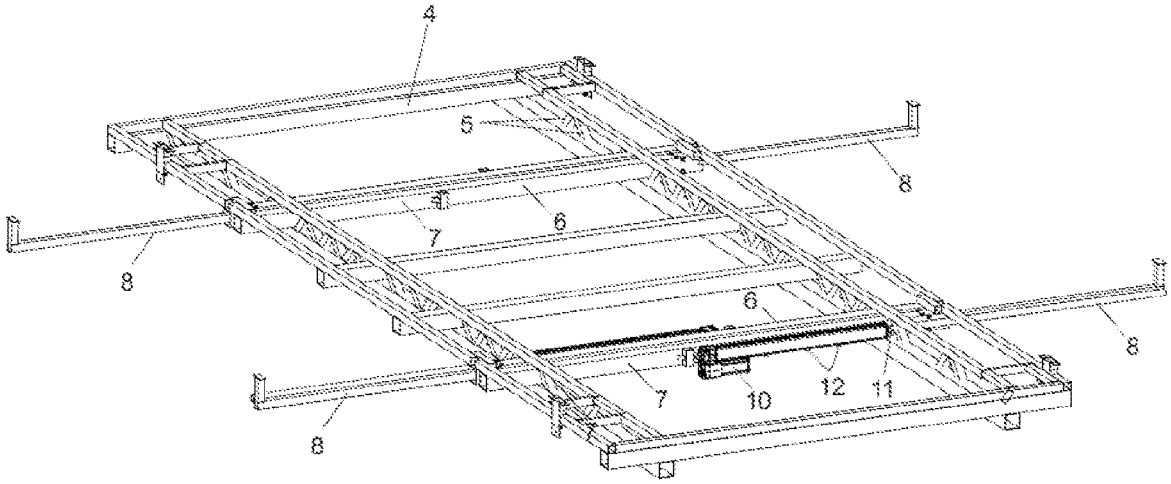
FIG. 4 illustrates the frame 4 and the expansion mechanisms 6 in the expanded state.
Figure 5:
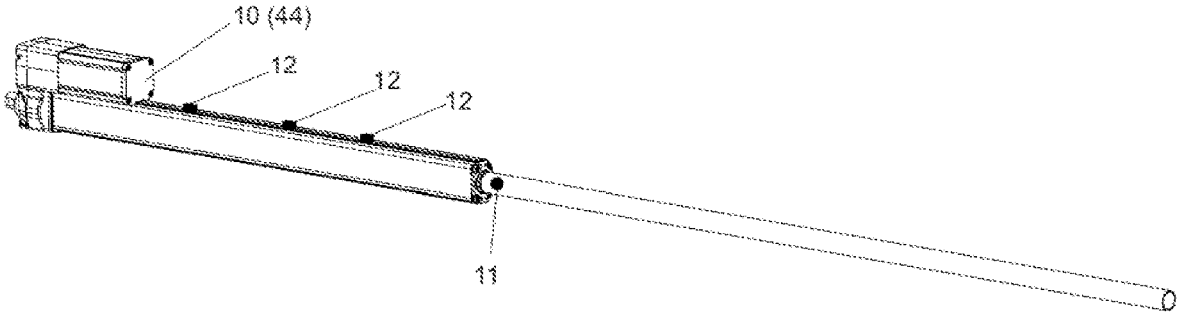
FIG. 5 illustrates the linear motors 10 of the expansion mechanism 6/the linear motors 44 of the support mechanism 44, the magnet 11 and the magnetic sensors 12.

Each of the expansion mechanisms 6 comprises the linear motor 10 and is connected thereto (FIG. 4, 5). Each of the linear motors 10 is mounted adjacent to the corresponding stationary guiding tie 7. The rod of the linear motor 10 is rigidly connected to the internal movable push-out tube 8 in order to provide the tube with the mechanical horizontal movement. All the expansion mechanisms 6 and their linear motors 10 are synchronized between each other in order to avoid imbalances and jamming of the slide-out modules 3 during their movements (sliding-out outwardly or retraction inside the stationary module 2). In order to provide the "synchronization" of the operation of the expansion mechanisms 6 and the linear motors 10, individual embodiments of the invention may utilize the magnets 11 on the rods of the linear motors 10 and the magnetic sensors 12 on the external cases of each of the linear motors 10 (FIG. 5) which form "check points" which are intended to transmit, to the control unit 29, certain signals about certain positions of the linear motors 10 and of the internal movable push-out tubes 8 which the slide-out modules 3 are attached to. This solution enables to adjust and to synchronize the movements of these linear motors 10 and of the internal movable push-out tubes 8 with the attached slide-out modules 3. Detailed description of the operation of the set of the expansion mechanisms 6 and their synchronization will be provided hereinafter.

Figure 19:
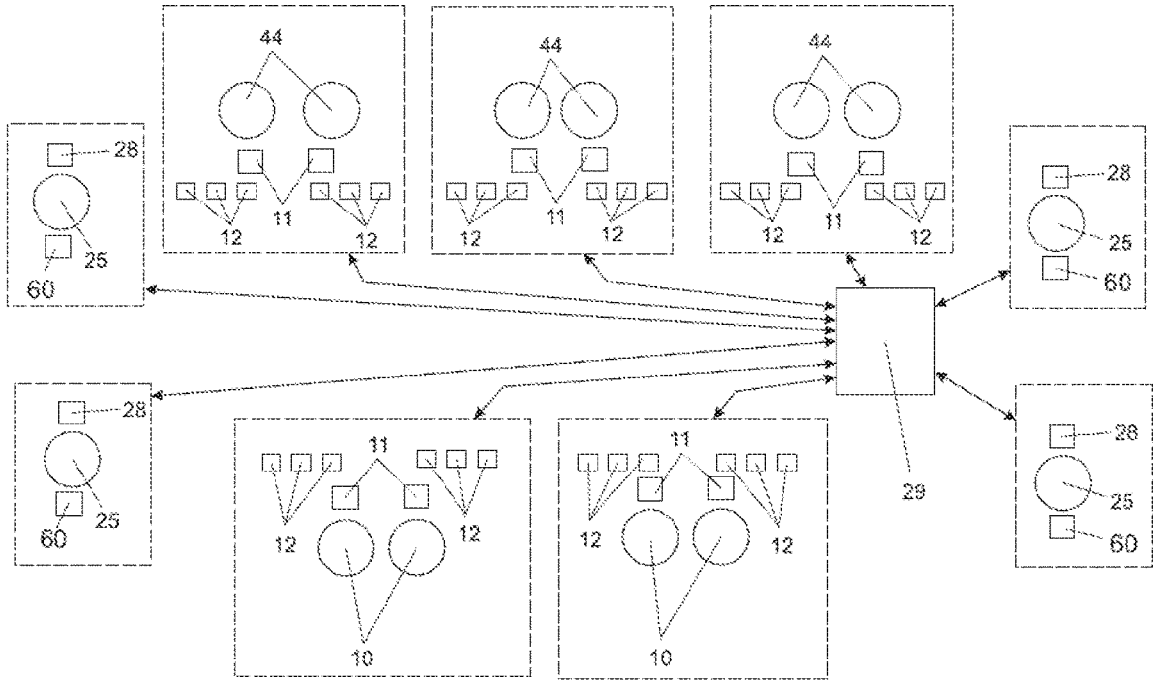
FIG. 19 illustrates the connection/communication scheme between the control unit 29 and the linear motors 10 of the expansion mechanisms 6, the linear motors 44 of the support mechanisms 13, the magnets 11 of the motors 10 and 44, the magnetic sensors 12 of the expansion mechanisms 6 and the support mechanisms 13, the linear motors of the lifting mechanisms 20, the weight sensors 28 of the lifting mechanisms 20.

All the linear motors 10 of all of the expansion mechanisms 6 are connected to the control unit 29 (FIG. 19). Software of the controller of the control unit 29 enables the user, by means of the personal electronic digital device, to control the linear motors 10 and, thus, stoppages and movements of the linear motors 10 together with the internal movable push-out tubes 8 of the expansion mechanisms 6 which the slide-out modules 3 are attached to. Electric motors or other motors which may be powered by any known energy supply means (accumulator, generator, mains voltage 220 etc.) may be used as the linear motors 10 of the expansion mechanisms 6.

The support mechanisms 13 of the slide-out modules 3 (FIG. 1, 2, FIG. 7—11).

As mentioned above, the transportable expandable structure 1 comprises more than one support mechanism 13 for supporting the slide-out modules 3. The support mechanisms 13 are mounted in the upper part of the structure 1 horizontally in width in such a way that their elements are connected to the stationary module 2 and to the slide-out modules 3 (FIG. 1, 2).

Figure 7:
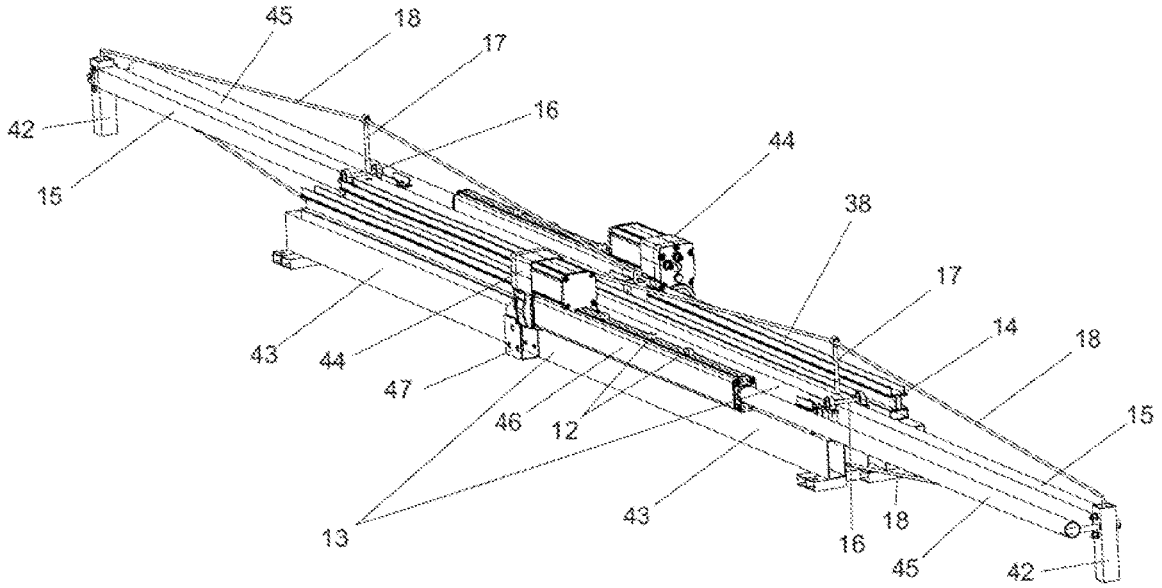
FIG. 7 illustrates the pair of the support mechanisms 13 in the expanded state.

Each of the support mechanisms 13 is an individual set of profile elements and rollers. Each of the support mechanisms 13 is formed by at least three profile elements, namely, by two stationary U-shaped profile beams 14 with the internal movable push-out tube 15 that is movably mounted between them (by means of several rollers), and the tube, preferably, has a rectangular profile, but without limitation thereto (FIG. 7, 8, 11). Each of the support mechanisms 13 comprises the linear motor 44 with the rod 45 that is bound to the push-out tube 15 (FIG. 7, 8) (detailed description of the binding will be provided hereinafter).

In separate embodiments of the invention, each of the two stationary U-shaped profile beams 14, accordingly, has the U-shaped profile and mounted in the support mechanism 13 sideways (with its open cavity) relative to the internal movable push-out tube 15. That is, the internal movable push-out tube 15 is a "central" element, and the two stationary U-shaped profile beams 14 are mounted along and on either side of the "central" element and faced with their open cavities towards the side walls of the internal movable push-out tube 15 in such a way that a free space is formed between the side walls of the internal movable push-out tube 15 and the walls of the two stationary U-shaped profile beams 14 (but the free space is limited by said walls), and the free space is intended to allow the rollers to move along the length of said profile elements of the support mechanism 13.

Figure 8:
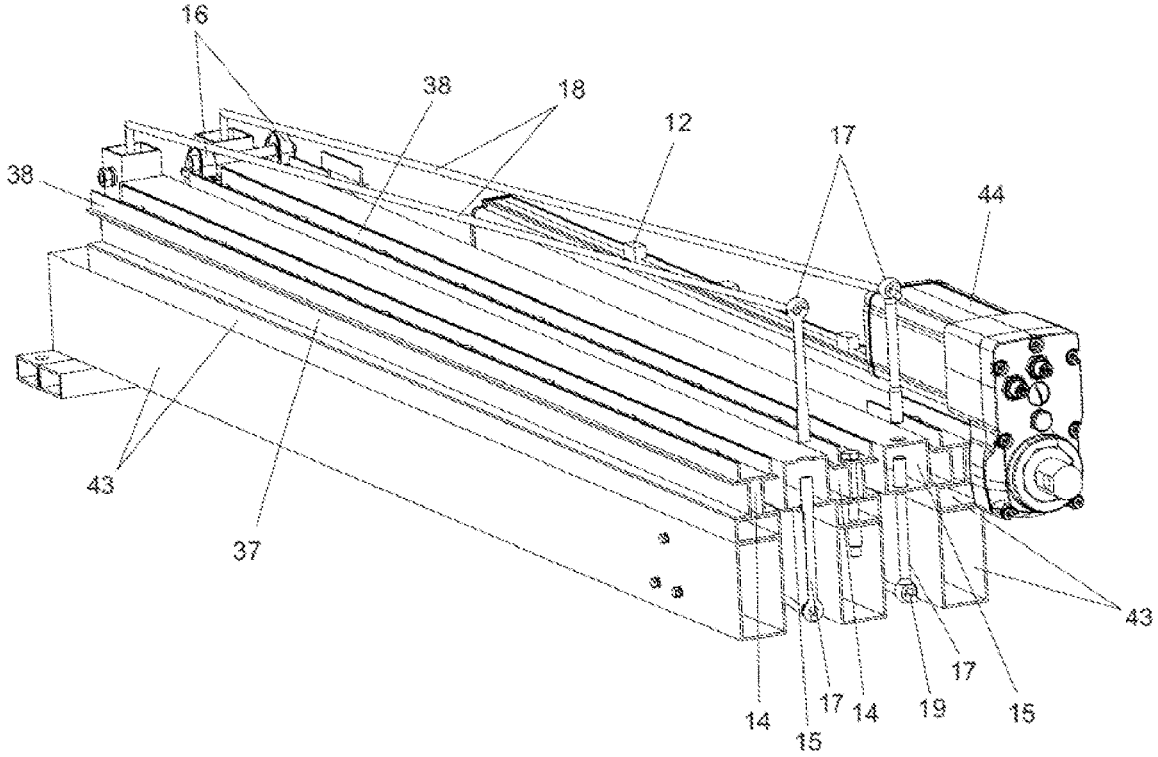
FIG. 8 illustrates a part of the pair of the support mechanisms 13 (cross-sectional view)
Figure 9:
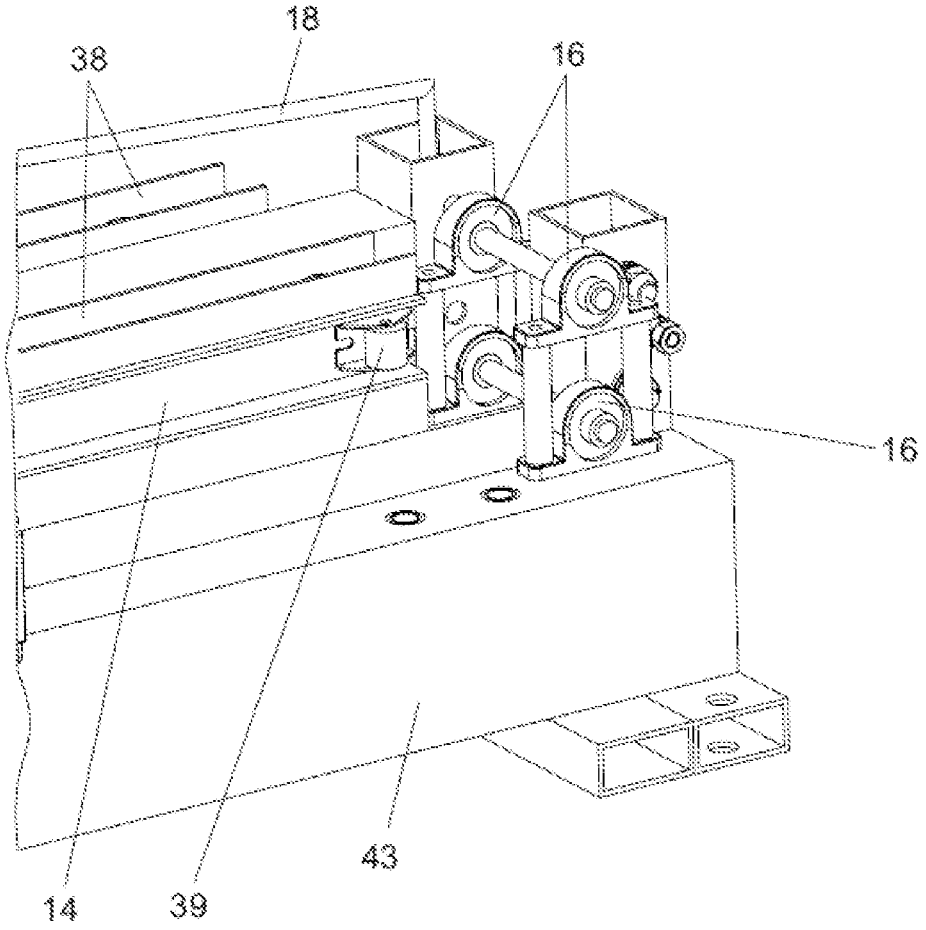
FIG. 9 illustrates the set of rollers 16 and the rollers 39 of the support mechanism 13.

In order to provide rigidity of the structure of the support mechanism 13, the additional U-shaped stationary profile beams 37 are mounted adjacent and parallel to each of the stationary U-shaped profile beams 14 (FIG. 8). Each of the additional U-shaped stationary profile beams 37 is mounted sideways (faced with its open cavity) in the support mechanism 13 from the internal movable push-out tube 15. The upper parts of these parallel beams 14 and 37 are bound along the entire length by the upper U-shaped profile element 38 that is mounted and attached with its horizontal plane at the bottom and with its open cavity at the top (FIG. 7—9). It should be noted that when the support mechanism 13 is paired (as preferred in the claimed invention) and the pair of the support mechanisms 13 comprises two internal movable push-out tubes 15 (FIG. 8), then each of these tubes 15 will be surrounded on both sides with the stationary U-shaped profile beams 14 (four in total). In this case, two beams 14 which are arranged at the center (inside) of the pair of the support mechanisms 13 are mounted and bound in the same way as the "uttermost" beams 14 and 37.

Two external sets of rollers 16 are mounted at the end of the support mechanism 13, the sets of rollers are formed by bearings and shafts which rotate by means of said bearings (FIG. 7—10). The sets of rollers 16 are horizontally secured at the top and at the bottom between the stationary U-shaped profile beams 14 in such a way that the internal movable push-out tube 15 is mounted between the upper and the lower shafts of these sets of rollers. When the push-out tube 15 moves outwardly from or inside the support mechanism 13, it (i.e., the push-out tube 15) will freely roll on the rotating shafts of the sets of rollers 16, and these shafts maintain (align the movement) the push-out tube 15 in the vertical plane (at the top and at the bottom) from that side of the support mechanism 13, where the movable push-out tube 15 pushes out. That is, the two external sets of rollers 16 facilitate the movement of the push-out tube 15 and limit its possible vertical gap. One internal roller 39 is mounted and secured both at the end of the support mechanism 13 in the area of the sets of rollers 16 as well as in the internal cavity of each of the two stationary U-shaped profile beams 14 (FIG. 9) in such a way that these two rollers 39 surround the internal movable push-out tube 15 on both sides. Accordingly, the internal rollers 39 facilitate the movement of the push-out tube 15 between the two stationary U-shaped profile beams 14 outwardly from or inside the support mechanism 13, as well as limit any possible horizontal gap of the push-out tube 15. Therefore, four rollers (two sets of rollers 16 and two internal rollers 39) are mounted at the end of the support mechanism 13, and these rollers facilitate the movement of the push-out tube 15 at the top, at the bottom and on two sides as well as limit its possible vertical and horizontal deviations/gaps.

At the same end of the support mechanism 13, the bracket 42 is attached to the internal movable push-out tube 15 (FIG. 7), and the bracket is to be connected to the slide-out module 3.

The movable end of the rod 45 of the linear motor 44 is attached to the bracket 42 (FIG. 7). The linear motor 44 itself is mounted roughly at the central part of the support mechanism 13 in such a way that its rod 45 is parallel to the push-out tube 15 and adjacent to this push-out tube 15. Therefore, the rod 45 is bound to the push-out tube 15 via the bracket 42, but this binding may be provided in another way. The system formed by the linear motor 44 with the rod 45 comprises the casing 46 for the rod 45 (FIG. 7). The linear motor 44 is rigidly attached to one of the stationary U-shaped profile beams 14 by means of the bracket 47. All the linear motors 44 of all of the support mechanisms 13 are connected to the control unit 29 (FIG. 19). All the linear motors 44 of all of the support mechanisms 13 are synchronized between each other (the synchronization of the linear motors 44 may be implemented in the same way as in the linear motors 10 of the expansion mechanisms 6 by means of the same magnets 11 and magnetic sensors 12, or in another way), and they are synchronized with the linear motors 10 of the expansion mechanisms 6 (FIG. 5). Software of the controller of the control unit 29 enables the user, by means of the personal electronic digital device, to control the linear motors 44 (simultaneously with controlling the linear motors 10 of the expansion mechanisms 6) and, thus, stoppages and movements of the linear motors 44 together with the push-out tubes 15 of the support mechanisms 13 which the slide-out modules 3 are attached to. Electric motors or other motors which may be powered by any known energy supply means (accumulator, generator, mains voltage 220 etc.) may be used as the linear motors 44 of the support mechanisms 13.

Figure 10:
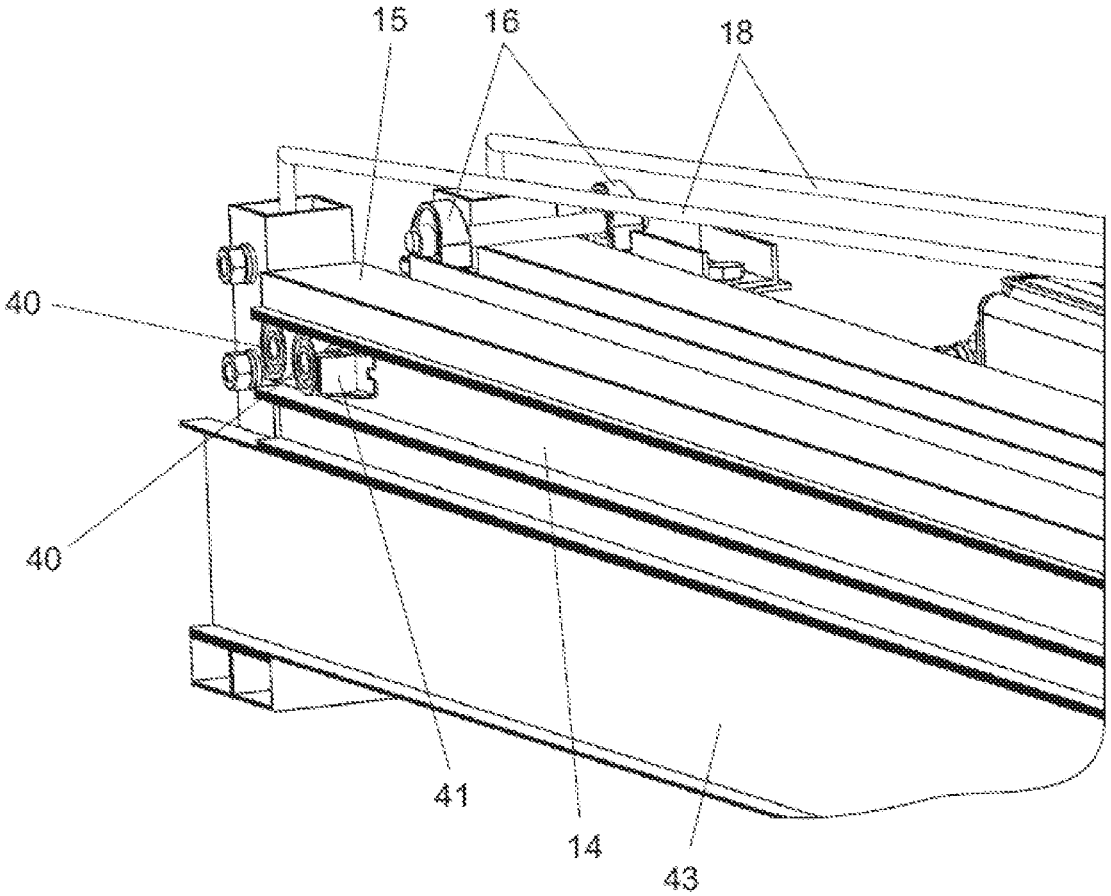
FIG. 10 illustrates the set of rollers 40, 41 of the support mechanism 13 (longitudinal section)
Figure 11:
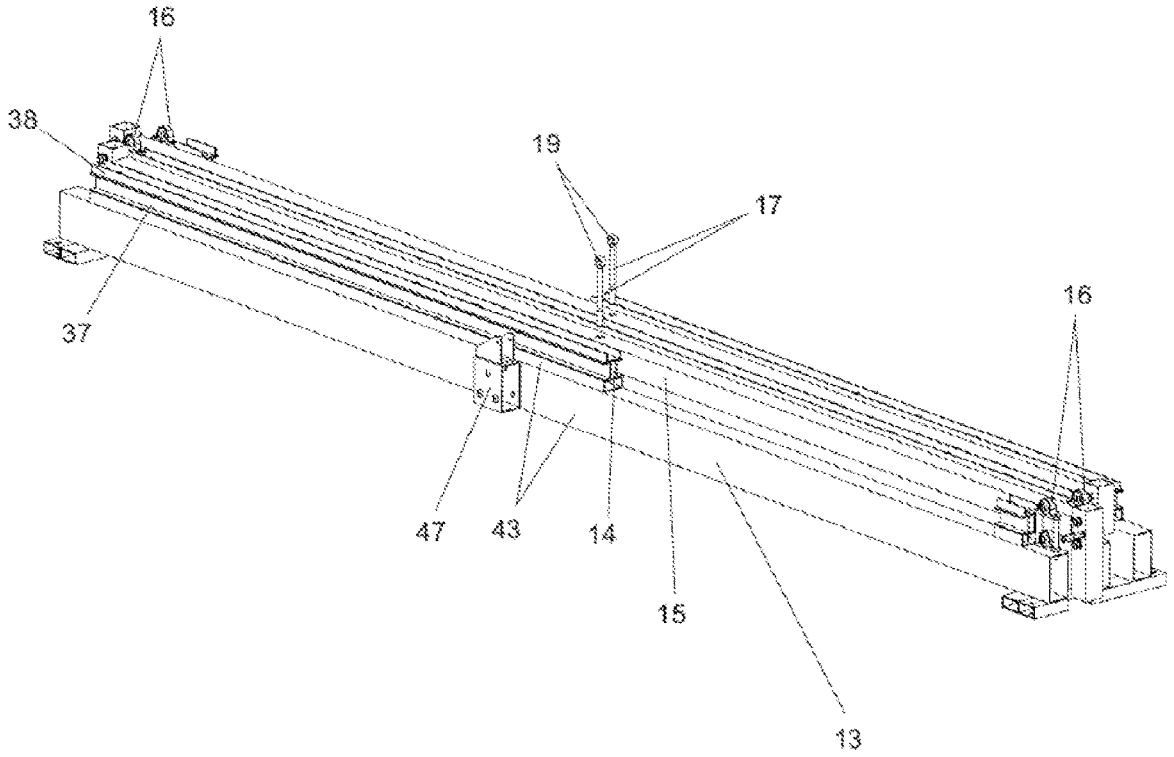
FIG. 11 illustrates details of the folded pair of the support mechanisms 13, the stationary U-shaped profile beams 14, the internal movable push-out tube 15, the masts 17 with the openings 19.

Four internal rollers 40 and 41 are also mounted at the opposite end (relative to the bracket 42) of each of the support mechanism 13, i.e., at its "start point" (FIG. 10). Two internal rollers 40 are mounted and secured vertically in the internal cavity of one of the two stationary U-shaped profile beams 14 in such a way that one roller 40 is arranged closer to the top and presses against the upper plane of the beam 14, while the second roller 40 is arranged closer to the bottom and presses against the lower plane of the beam 14. These two rollers 40 are mounted adjacent to each other and rotate in the vertical plane. Also, one of the rollers 41 that rotates in the horizontal plane is mounted adjacent to these two rollers 40, while the second roller 41 that also rotates in the horizontal plane is mounted in the same way on another side of the stationary U-shaped profile beam 14. These two rollers 41 are those rollers which the internal movable push-out tube 15 rolls on.

Therefore, two sets of rollers 40 and 41 (at the start) and 16 and 39 (at the end) are mounted on two sides of the support mechanism 13, and these sets allow and facilitate to:

- provide free and easy movements of the internal movable push-out tube 15 (or two tubes 15 in case of the paired system) between the walls of the two stationary U-shaped profile beams 14;
- arrange the rollers 39, 40, 41 between the walls of the two stationary U-shaped profile beams 14 and the walls of the corresponding internal movable push-out tube 15, thereby providing a certain sealing between these elements in order to avoid any gaps, imbalances, bends, jamming.

The pair of the support mechanisms 13 is made in such a way that it comprises two internal movable push-out tubes 15 and four stationary U-shaped profile beams 14 which are arranged and made in such a way that the two internal movable push-out tubes 15 move and push-out/retract in opposite directions, while all the four stationary U-shaped profile beams 14 remain stationary (FIG. 8). Accordingly, the pair of the support mechanisms 13 comprises two linear motors 44 with the rods 45 and the casings 46 which are attached to the corresponding (external) stationary U-shaped profile beams 14 by means of the brackets 47.

Therefore, each of the pairs of the support mechanisms 13 is configured to expand/retract the internal movable push-out tubes 15 horizontally in different opposite directions along the length of the support mechanism 13.

The support mechanism 13 comprises at least two vertical masts 17 (FIG. 7, 8, 11) which are mounted on the horizontal internal movable push-out tube 15 both at the top and at the bottom. If the support mechanism 13 is paired, then four masts will be provided. Two reinforcing ropes 18 (FIG. 7—10) are stretched through the openings 19 (FIG. 8, 11) of each of the vertical masts 17 along the length of the movable push-out tube 15, and ends of the ropes are secured at the ends of the movable push-out tube 15. One rope 18 is stretched at the top through the upper mast 19 of the movable push-out tube 15, while the second rope 18 is stretched at the bottom through the lower mast 19 of the movable push-out tube 15. The two stretched ropes 18 form a compensatory load both at the top and at the bottom acting onto the horizontal movable internal push-out tube 15. Owing to this mutual compensatory load, the two ropes 18 provide a minimum possibility of buckling of the internal movable push-out tube 15 under the weight of the slide-out modules 3, when this tube 15 is pushed out outwardly from the stationary U-shaped profile beams 14 of the support mechanism 13 and, accordingly, from the stationary module 2. When the overall weight of each of the support mechanisms 13 together with the two ropes 18 is about 30 kg, the weight of the slide-out module 3 at each of the ends of the internal movable push-out tube 15 of one support mechanism 13 may be up to about 250 kg. Therefore, when the own weight of the support mechanisms 13 is low, their structural features in combination with the ropes 18 will allow to provide a sufficiently high rigidity of the structure 1 in terms of "reliable maintaining the slide-out modules 3 in the expanded position during the time that is required to provide the lower support of the slide-out modules 3 on the horizontal surface or even without use of this lower support". Similar trusses may be used instead of the masts 17 and the ropes 18 in the support mechanism 13.

In preferable embodiments of the invention, the transportable expandable structure 1 may comprise four slide-out modules 3, two on each side from the stationary module 2 (FIG. 1, 16). Also, as mentioned above, in these cases, the structure 1 utilizes the pairs of the support mechanisms 13 which enable to slide-out/retract all the four slide-out modules 3 simultaneously. Each of the pairs of the support mechanisms 13 comprises at least four stationary U-shaped profile beams 14 with two internal movable push-out tubes 15 (together with the corresponding linear motors 44 with the rods 45) movably arranged between them, and each of the tubes pushes out/retracts together with the slide-out module 3 in opposite directions. The sets of the U-shaped profiles 37, 38, the external sets of rollers 16, the internal rollers 39, the sets of rollers 40, 41, the masts 17 and the ropes 18 are made in the same way as in the described support mechanism 13 with the one internal movable push-out tube 15 and with two stationary U-shaped profile beams 14.

It should be noted that the stationary U-shaped profile beams 14, 37 in the structure of the support mechanism 13 may be mounted and secured on the additional profile elements/tubes 43 (FIG. 7—11) or on the similar ones which intend to provide the rigidity of the structure and to provide a more convenient attachment of the elements of the support mechanism 13 to the stationary module 2 and to the slide-out modules 3.

The support mechanisms 13 are mounted in the upper part (in the ceiling area) of the stationary element 2 transversely to its length (FIG. 1, 2). The stationary profile beams 14, 37 are rigidly attached to the horizontal plane of the ceiling of the stationary module 2 via the additional profile elements/tubes 43, while the internal movable push-out tubes 15 with the stretched ropes 18 are rigidly attached to the vertical planes of the ceilings of the slide-out modules 3 which, accordingly, slide out outwardly from the stationary module 2 (or retract inside the stationary module 2) simultaneously with pushing-out/retraction of the internal movable push-out tubes 15. The slide-out modules 3 move owing to the simultaneous synchronized operation of the linear motors 44 of the support mechanisms 13 and of the linear motors 10 of the expansion mechanisms 6. The internal movable push-out tubes 15 with the ropes 18 move owing to the rollers 16, 39, 40, 41. Thus, according to the present invention, the support mechanisms 13, besides the "supporting" function, also act as drives together with the expansion mechanisms 6.

As mentioned above, in separate and preferable embodiments of the invention, the transportable expandable structure 1 comprises four slide-out modules 3 (two on either side) which are mounted in such a way that two slide-out modules 3 may slide out/retract at each side of the stationary module 2, and these pairs of the slide-out modules 3 which slide out towards the same direction are rigidly bound together. Therefore, in this case, the transportable expandable structure 1 comprises three pairs of the support mechanisms 13 (FIG. 1, 2) which are arranged in three locations in the upper part of the structure 1 horizontally in width (transversely to the stationary module 2) in such a way that the elements of the support mechanisms 13 are connected to the stationary module 2 and to the slide-out modules 3. That is, the three pairs of the support mechanisms 13 are mounted in such a way that one pair of the support mechanisms 13 is arranged at the center of the structure 1, while two other pairs of the support mechanisms 13 are arranged at the edges along the front and the rear parts of the structure 1. Therefore, in the mentioned embodiment of the invention, there are three pairs of the support mechanisms 13 mounted in the structure 1, and each of the bound pairs of the slide-out modules 3 is connected, in its upper part, to the corresponding three support mechanisms 13

Figure 16:
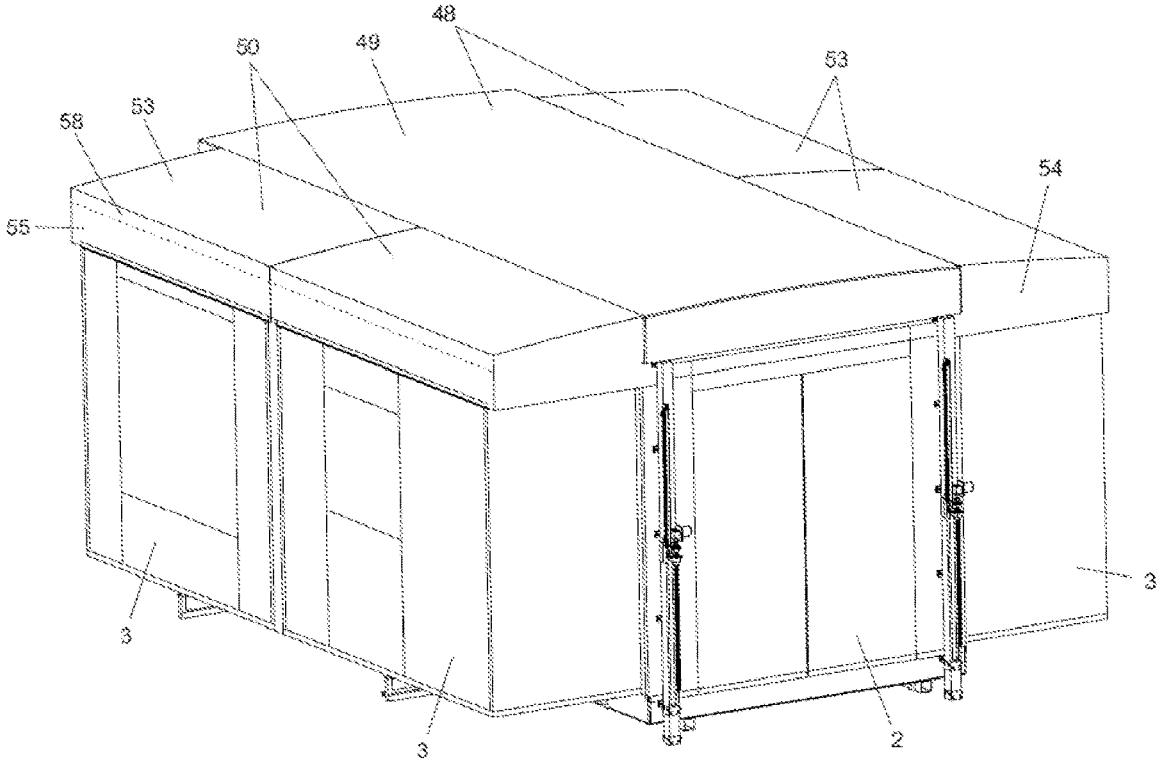
FIG. 16 illustrates the structure 1 with the expandable roof 48, when the slide-out modules 3 are in their slid-out position.
Figure 17:
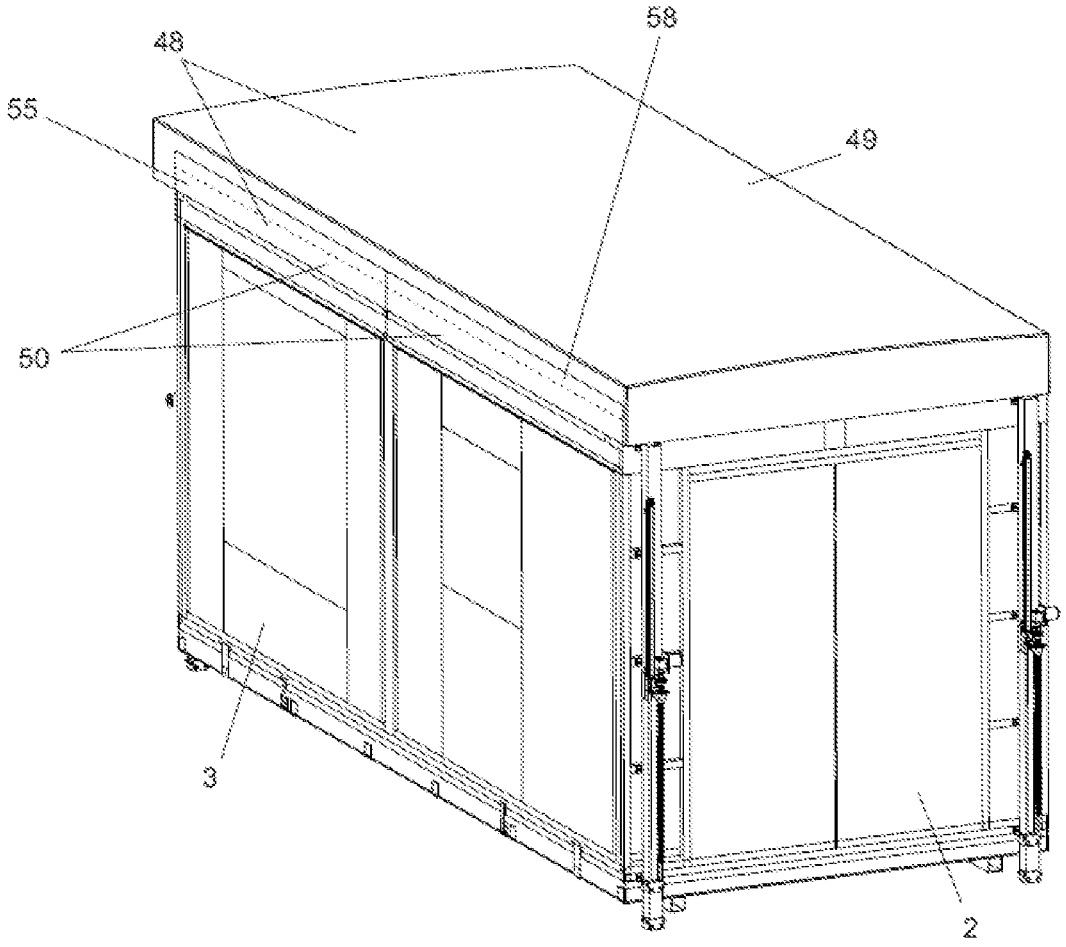
FIG. 17 illustrates the structure 1 with the expandable roof 48, when the slide-out modules 3 are inside the stationary module 2.
Figure 18:
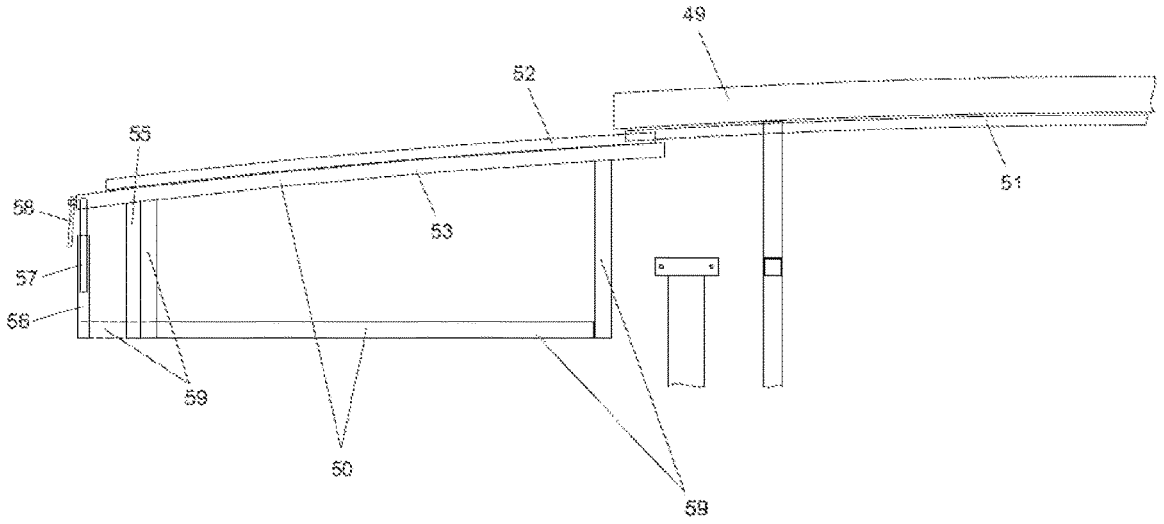
FIG. 18 illustrates elements and details of the expandable roof 48.

The Expandable Roof 48 (FIG. 16—18).

In separate embodiments of the invention, the transportable expandable structure 1 comprises the expandable roof 48 that, in turn, comprises the stationary part 49 and the movable expandable/retractable parts 50 (FIG. 16—18). The stationary part 49 of the roof is mounted and rigidly secured at the top (above the ceiling) of the stationary module 2. The expandable parts 50 of the roof are mounted and rigidly secured at the top (above the ceilings) of the movable modules 3. The stationary part 49 of the roof has a longitudinal U-shaped section and a slightly rounded upper part (a small rounding radius). Cavities that enable mounting of the expandable parts 50 of the roof therein (when the structure 1 is in the folded state) are provided under the stationary part 49 of the roof that is mounted at the top of the stationary module 2 and under the ceiling of the stationary module 2. Accordingly, openings are provided on either side of the stationary part 49 of the roof (i.e., there are no vertical walls/partitions on either side of the stationary part 49 of the roof) in order to enable free movements of the movable push-out parts 50 of the roof outwardly and/or inside (under the stationary part 49 of the roof).

Several guiding elements 51 (e.g., in the form of tubes with grooves) for the expandable parts 50 of the roof are mounted on the internal horizontal (rounded) plane of the stationary part 49 of the roof perpendicularly to the length of the stationary part 49 of the roof, while the corresponding profile elements 52, in turn, are mounted on the expandable parts of the roof (on their upper horizontal planes 53) (FIG. 18).

The expandable parts 50 of the roof are formed by the frame base 59 (FIG. 18, the upper horizontal planes 53 (FIG. 18) and the vertical planes 54 (FIG. 16), 55 (FIG. 17, 18)

which are arranged on three sides relative to the horizontal planes 53. All the planes 53, 54, 55 of the expandable parts 50 of the roof are attached to the frame base 59. The upper horizontal planes 53 have rounded shape and their rounding radius is the same as the rounding radius of the upper plane of the stationary part 49 of the roof. The vertical planes 54 of the expandable parts 50 of the roof are front and rear, while the vertical planes 55 are lateral (FIG. 16). When the expandable parts 50 of the roof push-out, the edges of the upper horizontal plane 53 slightly descend downwards (owing to the rounded shape of the vertical planes of the stationary parts 49 and of the expandable parts 50). While when the expandable parts 50 of the roof retract, the edges of the upper horizontal plane 53 slightly lift upwards (owing to the rounded shape of the upper planes of the stationary parts 49 and of the expandable parts 50), thereby resulting in formation of the horizontal slit in the area of the edges of the upper horizontal plane 53 of the expandable parts 50. In order to cover this slit, the following structural parts and details are provided and mounted in the structure of the expandable roof 48. As mentioned before, the lateral vertical planes 55 are attached to the elements of the frame base 59 (FIG. 18). The vertical tubes 56 are attached to the frame base 59 on the side edges of the expandable parts 50 in the area of the vertical planes 55 (FIG. 18). The internal bars 57 are mounted (so as to be vertically movable) inside the vertical tubes 56, and the upper parts of the bars are connected to the edges of the corresponding upper horizontal planes 53 of the corresponding expandable parts 50 of the roof (FIG. 18) in such a way that when the expandable parts 50 of the roof slide out, then, as mentioned above, the edges of the upper horizontal planes 53 will slightly descend downwards and, thus, the horizontal planes 53, by their own movement, directly push the internal bars 57 in the openings of the vertical tubes 56 downwards as well. While when the expandable parts 50 of the roof expand, the edges of the upper horizontal planes 53 will slightly lift upwards and, thus, the horizontal planes 53, by their own movement, pull the internal bars 57 therewith in the openings of the vertical tubes 56 upwards. The planar vertical flaps 58 are attached to the outer edges of the upper horizontal planes 53 in a non-rigid fashion (so as they are movable in attachment points) (FIG. 18), and the flaps are mounted along the entire length of the corresponding lateral vertical planes 55 on either side of the corresponding expandable parts 50 of the roof (FIG. 16, 17). Therefore, during retraction of the expandable parts 50 of the roof, when the edges of the upper horizontal plane 53 slightly lift upwards resulting in that the horizontal slit is formed in the area of the edges of the upper horizontal plane 53 of the expandable parts 50, the horizontal planes 53 will pull the internal rods 57 in the openings of the vertical tubes 56 upwards together with the flaps 58 in such a way that these flaps 58 cover, with their planes, the formed slits (FIG. 17). When the expandable parts 50 of the roof are slid-out, the slits will disappear, while the flaps 58 will descend downwards and vertically suspend over the side vertical planes 55 (FIG. 16). This structure and operation of the set of the flaps 58 further provides thermal insulation of the structure 1.

Generally, the expandable roof 48 covers the support mechanisms 13 for supporting the slide-out modules 3 (both in the retracted position and in the expanded position) at the top and on either side, and protects all the elements and details of the support mechanisms 13 against environmental exposure (snow, rain, wind, humidity and other factors). Besides, the expandable roof 48 provides the structure 1 with more aesthetic visual appearance.

The lifting mechanisms 20 (FIG. 1, 2, 12, 13).

Figure 2:
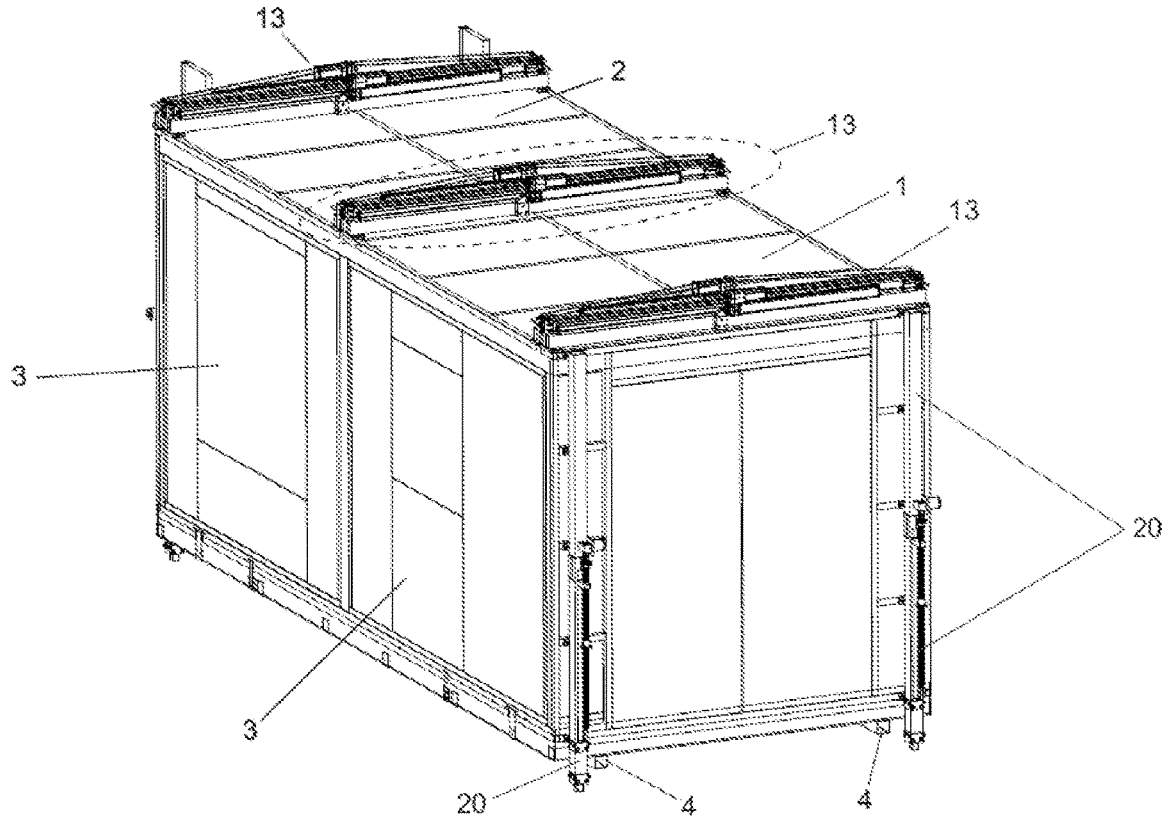
FIG. 2 illustrates a general view of the non-expanded structure 1, the stationary module 2 with the slide-out modules 3.

In separate embodiments of the invention, the transportable expandable structure 1 comprises the lifting mechanisms 20 which are vertically movable (retractable/expandable). The structure may comprise, for example, four lifting mechanisms 20 which are vertically mounted in corners of the stationary module 2 (FIG. 2). In the same way, the lifting mechanism 20 may be vertically mounted in the lower part or, e.g., in the corner of each of the slide-out modules 3 (the lifting mechanism 20 directly for the slide-out modules 3 is now illustrated in the figures). That is, the number of the lifting mechanisms 20 may be different depending on a certain configuration, dimensions and weight of the structure 1 and its modules.

The lifting mechanisms 20 are intended to provide:

- convenient and quick removal of the structure 1 from the trailer or the vehicle;
- convenient and quick loading of the structure 1 on the trailer or the vehicle;
- bearing of the structure 1 on the horizontal surface;
- convenient and quick horizontal alignment of the entire structure 1 and its modules;
- stability of the structure 1 on the horizontal surface that may be smooth (e.g., asphalt or concrete pavement) or rough (e.g., soil, grass surface etc.).

At least four lifting mechanisms 20 should be provided (providing the arrangement in the corners of the stationary module 2), but without limitation thereto.

Figure 13:
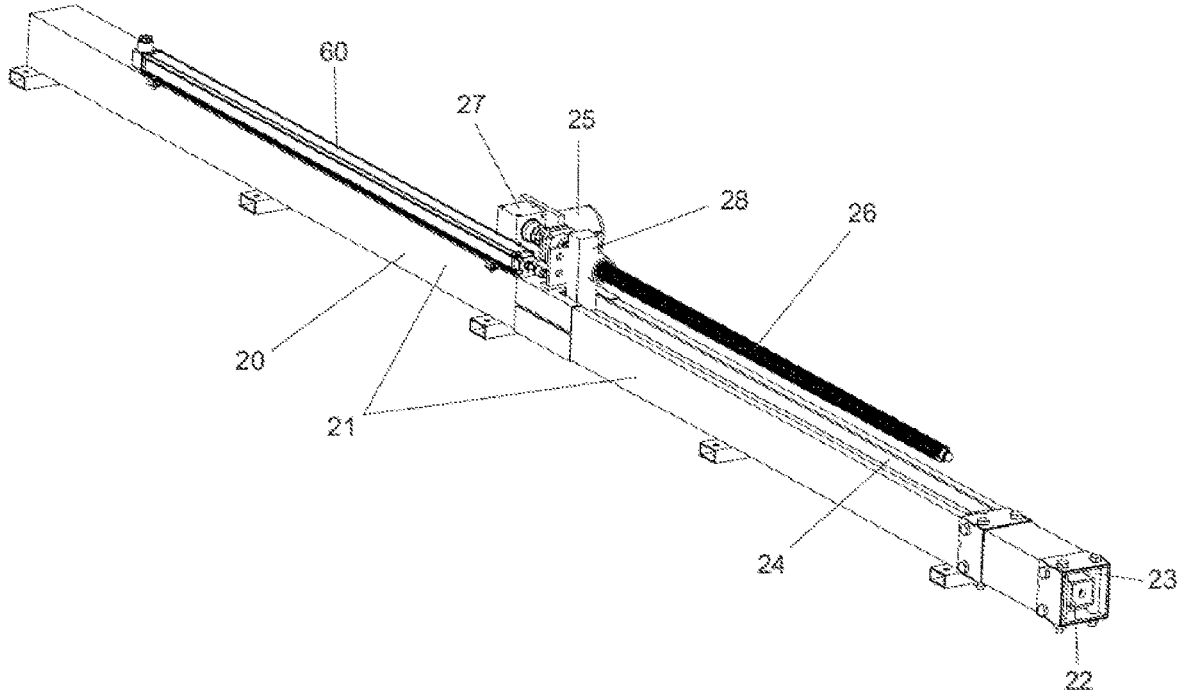
FIG. 13 illustrates the lifting mechanisms 20, the rollers 23, the linear motor 25, the ball screw pair 26, the reduction gear 27.

The structure of each of the lifting mechanisms 20 is made as "tube in a tube" and has the set of internal rollers 23 (FIG. 13). That is, each of the lifting mechanisms 20 is formed by the external stationary tube 21, the internal movable tube 22 and the rollers 23 (FIG. 13). The external stationary tubes 21 of the lifting mechanisms 20 are rigidly attached (e.g., bolted or welded, but without limitation thereto) to the stationary module 2 and, in some cases, to the slide-out modules 3. The internal movable tubes 22 are mounted in the lifting mechanisms 20 in such a way that they could move vertically upwards/downwards relative to the external stationary tubes 21 and, thus, relative to the modules which the external stationary tubes 21 are rigidly attached to. The rollers 23 facilitate the vertical movement of the "tube in a tube" and press the internal movable tube 22 in the external stationary tube 21 in such a way that the free movement of the "tube in a tube" in different directions is limited, while only the vertical movement of the "tube in a tube" is possible. That is, the rollers 23 and their arrangement system, except for providing the movement of the "tube in a tube", also avoid significant imbalances and buckling of the lifting mechanisms 20 in case of a side load. Accordingly, the rollers 23 also avoid jamming of the internal movable tube 22 in the lifting mechanism 20 system, because their structure, number and arrangement system inside the lifting mechanism 20 arm between the tubes 21, 22 in case of the side load avoid significant buckling of the arm of the entire lifting mechanism 20. Therefore, the rollers 23 in the lifting mechanism 20 system have a dual function by serving as both: "movement facilitation elements" and "reinforcing seals".

Figure 12:
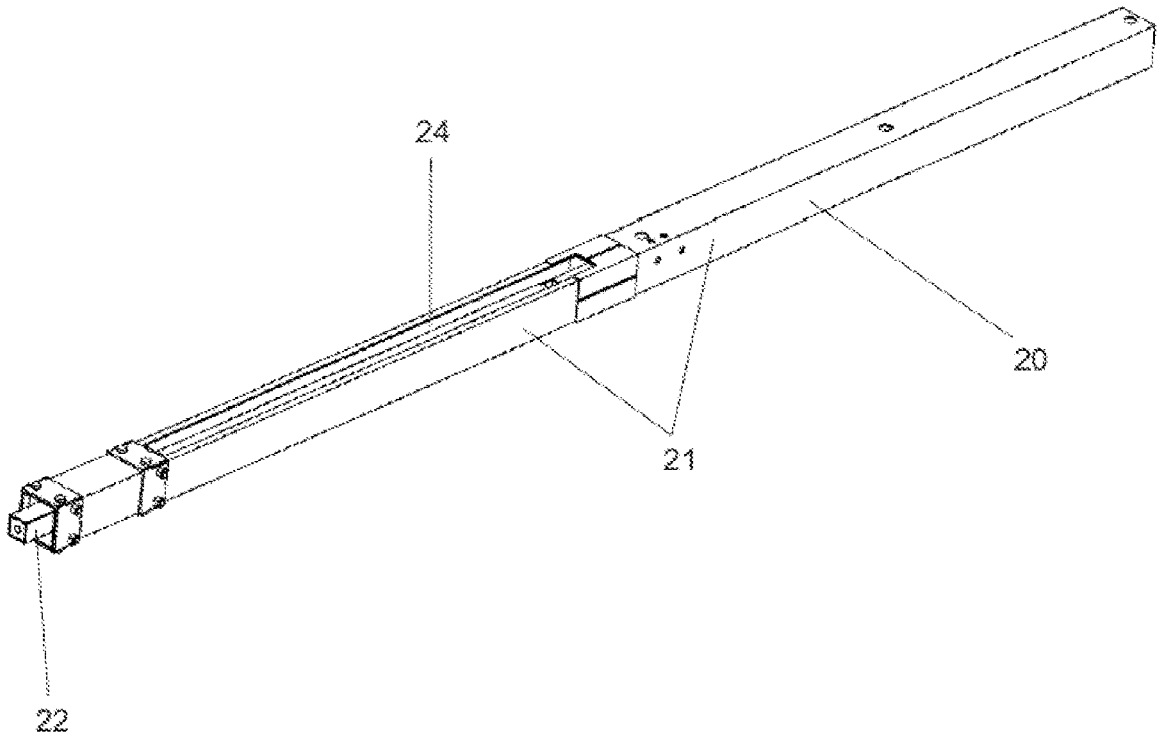
FIG. 12 illustrates the lifting mechanisms 20, the external stationary tube 21, the internal movable tube 22, the slit 24.

Besides, the external stationary tube 21 of each of the lifting mechanisms 20 comprises the slit 24 (FIG. 12, 13), while the linear motor 25 is connected to each of the lifting mechanisms 20 through the slit, and the linear motor enables the movement of the internal movable tube 22 relative to the external stationary tube 21 (FIG. 13). The linear motor 25 is connected to the lifting mechanism 20 by means of the ball screw pair 26 (FIG. 13), but skilled artisans would understand that this connection may be different (without limitation to use of the ball screw pair 26). The ball screw pair 26 is mounted inside the lifting mechanism 20 and, owing to the ball screw pair, the linear motor 25 transfers the mechanical movement to the internal movable tube 22 and vertically "pushes out" this internal movable tube 22 from the external stationary tube 21. When the internal movable tube 22 touches the horizontal surface, the lifting mechanism 20 will "bear" against this horizontal surface and, thus, it will become possible to lift the entire structure 1 or a part thereof (e.g., any of the corners) upwards. The vertical movement downwards is provided in the opposite way, i.e., by means of the linear motor 25, the ball screw pair 26 and mobility of the internal movable tube 22 by means of the rollers 23 inside the external stationary tube 21. In order to transfer the mechanical movement of the linear motor 25 effectively and in order to enable stoppage and fixation of the position of the internal movable tube 22 and, accordingly, in order to enable rigid fixation of the lifting mechanism 20 at a certain position, the lifting mechanism 20 comprises the reduction gear 27 (FIG. 13). Besides, the weight sensor 28 and the position sensor 60 also may be mounted in the lifting mechanism 20 system (FIG. 13, 19), and the position sensor is rigidly connected to the internal movable tube 22 to control the position of this internal tube 22. Accordingly, the weight sensor 28 and the position sensor 60 are electrically connected to the control unit 29 (FIG. 19) (it should be noted that the weight sensor 28 and the position sensor 60 may be have another connection to the control unit 29 other than the "electric" one by means of any wireless communication means). Therefore, the mechanical transmission chain of the lifting mechanism 20 may be, e.g., as follows: the linear motor 25—the reduction gear 27—the ball screw pair 26—the weight sensor 28—the internal movable tube 22—the position sensor 60, but without limitation thereto. In most of embodiments of the structure 1, the lifting mechanisms 20 usually comprise the weight sensor 28 and the position sensor 60. It is obvious that the lifting mechanism 20 will operate and perform its functions without these weight sensors 28 and position sensors 60, but these sensors provide each of the lifting mechanisms 20 with much more functionality.

All the linear motors 25 of all of the lifting mechanisms 20 are connected to the control unit 29 (FIG. 19).

Electric motors or other motors which may be powered by any known energy supply means (accumulator, generator, mains voltage 220 etc.) may be used as the linear motors 25 of the lifting mechanisms 20. Also, in separate embodiments of the invention, the linear motors 25 of the lifting mechanisms 20 may comprise the position sensors 60. Besides, in separate embodiments, the transportable expandable structure 1 may utilize various tilt sensors to control the horizontal alignment of the structure and its elements (not indicated by numerical positions and not depicted in the figures).

In separate embodiments of the invention, the transportable expandable structure 1 may be made without any lifting mechanisms 20. In these embodiments, the stationary module 2 comprises support brackets (not indicated by numerical positions and not depicted in the figures) or supporting and fastening elements (not indicated by numerical positions and not depicted in the figures) in order to enable horizontal mounting or mounting and fixation on the trailer or on the cargo bay of the vehicle. This structure 1 is to be used directly on the trailer or on the cargo bay of the vehicle. If the structure comprises the support brackets, then it will be possible to remove it from the trailer by means of additional means (e.g., by means of a crane), to mount on the horizontal surface and to use it as intended. In the same way, this structure 1 with the support brackets may be loaded on the trailer or on the cargo bay of the vehicle by means of additional means.

In other separate embodiments of the invention, the transportable expandable structure 1 also may be made without lifting mechanisms 20, and in this case, it comprises a wheeled chassis (not indicated by numerical positions and not depicted in the figures) that is arranged in the lower part of the stationary module 2. Accordingly, the structure 1 with the wheeled chassis acts as a trailer of the vehicle and may be used at a location where it has been transported without any removal from the trailer. In these cases, wheels themselves and other additional details act as support elements.

The Control Unit 29 (FIG. 19).

The transportable expandable structure 1 comprises the controller-based control unit 29 having the corresponding software. The control unit 29 is in communication with all the linear motors 10 of the expansion mechanisms 6 and with the linear motors of the lifting mechanisms 20, with all the provided sensors and with other possible electronic elements of the structure 1.

In separate embodiments of the invention, the control unit 29 may comprise wireless communication means, e.g., a Bluetooth module, a Wi-Fi module, but without limitation thereto (the wireless communication means are not indicated with numerical positions and are not illustrated in the figures). In these embodiments, the wireless communication means and software of the control unit 29 are configured to exchange signals, data and information with personal electronic digital user devices. That is, a user of the structure 1 is able to supply the required signals to the control unit 29 via the communication means (Bluetooth module, Wi-Fi module) by means of the personal electronic digital device (e.g., phone, smartphone, laptop etc.) having the corresponding software installed and set. These user-supplied control signals may include, for example: a command to "expand the slide-out modules 3 from the stationary module 2" or a command to "horizontally align the modules 2, 3 by means of the lifting mechanisms 20" etc. Also, the user is able to receive, for example, the following information from the software of the control unit 29 to the personal electronic digital device by means of the wireless communication means: about a current state of the slide-out modules 3, about a power system operation and state, other information.

The Power Supply System.

The transportable expandable structure 1 comprises the power system that provides illumination and power supply for the stationary module 2 and for all the slide-out modules 3 of the device 1. Also, all the linear motors 10 and 25, possible sensors, the control unit 29 and any other electronic devices and details which are used and may be used in the inventive structure are connected to the power supply system.

In separate embodiments of the invention, the transportable expandable structure 1 enables to mount and to use various household life support system such as: ventilation, heating, water supply-sewerage, thermal insulation (including sealing elements), noise insulation systems.

Heating, Water Supply-Sewerage.

If the transportable expandable structure 1 comprises heating and water supply-sewerage elements, then known devices, details and elements will be used in these systems.

Figure 15:
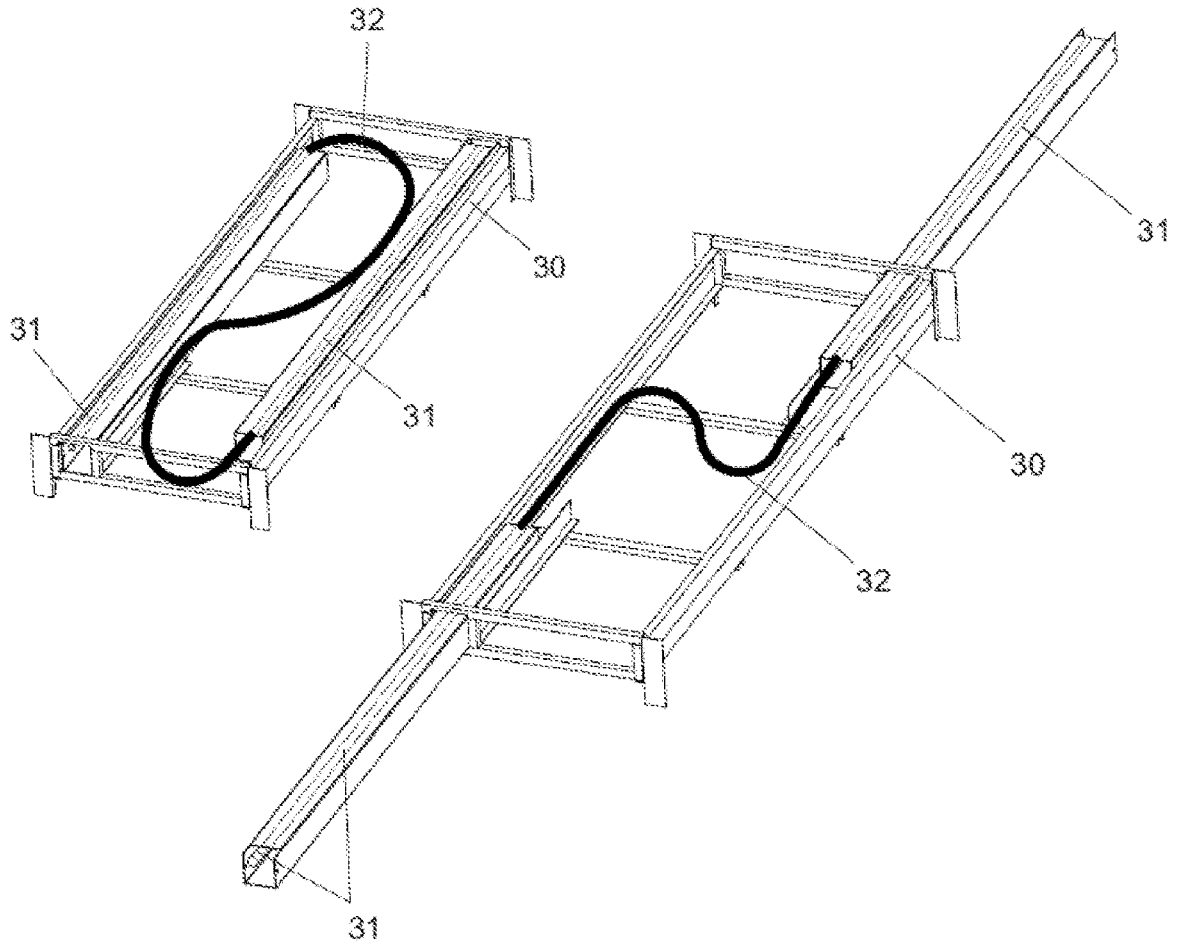
FIG. 15 illustrates the box structure 30 for the rigid tubes 31 and for the flexible hoses 32.

Water Tubes (FIG. 15).

In separate embodiments of the invention, the box structure 30 as a part of the heating and water supply-sewerage systems may be mounted under the floor and the bottom of the stationary module 2, and the rigid tubes 31 are accommodated inside the box structure (FIG. 15) to provide water supply and/or heat supply for the slide-out modules 3. The rigid tubes 31 are interconnected by means of the flexible hoses 32. The interconnected rigid tubes 31 and the flexible hoses 32, in turn, are connected to other water supply and/or heat supply means which are arranged in the stationary module 2 and in the slide-out modules 3. This solution enables to alter the shape and the length (to expand/retract) of the water/heat supply tubes 31, 32 when the slide-out modules 3 slide out outwardly or retract inwardly.

Thermal Insulation.

In separate embodiments of the invention, the transportable expandable structure 1 comprises thermal insulation elements. Thermal insulation plates made of, e.g., polyisocyanurate (of a PIR type), may be used as the thermal insulation elements. This material may constitute a sheathing for the walls, ceiling, other elements of the stationary module 2 and/or the slide-out modules 3.

In order to enhance the thermal insulation, vacuum glass may be used for the walls and other transparent elements of the transportable expandable structure 1.

The transportable expandable structure 1 may utilize any elements and materials which enhance the thermal insulation and warm the interior of the rooms.

Sealing.

Figure 14:
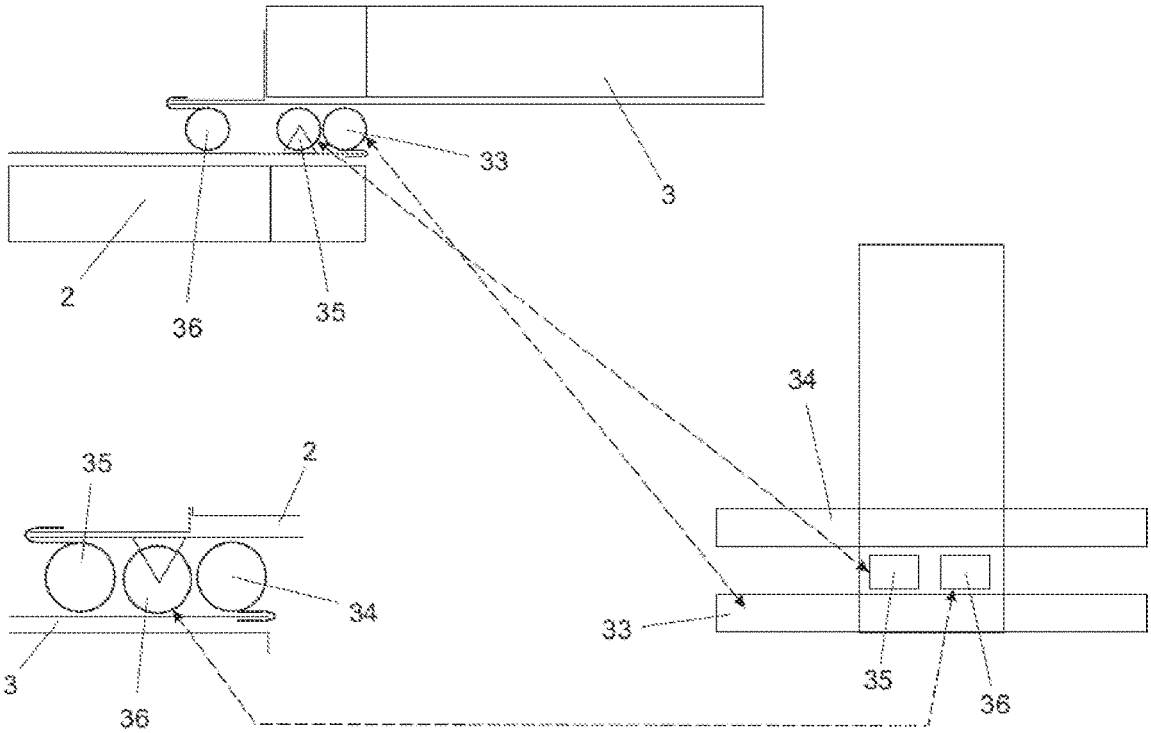
FIG. 14 illustrates the thermal insulation elements: the rubber gaskets 33 of the stationary module 2, the rubber gaskets 34 of the slide-out modules 3, the rollers 35 of the stationary module 2, the rollers 36 of the slide-out modules 3.

In separate embodiments of the claimed invention, sealing elements for sealing the rooms of the stationary module 2 and the slide-out modules 3 may be used as a part of the thermal insulation and sealing systems. This solution may be implemented in the following way. The rubber gaskets 33 are mounted at all the edges of the stationary module 2 which are connected to the slide-out modules 3 (along the entire perimeter of open parts of the stationary module 2) (FIG. 14). The rubber gaskets 34 are also mounted at all the edges of the rear parts of each of the slide-out modules 3 which are connected to the stationary module 2, i.e., along the entire perimeter of the rear part of each of the slide-out modules 3 (FIG. 14). Also, the rollers 35 of the stationary module 2 and the rollers 36 of the slide-out module 3 are mounted between the rubber gaskets 33, 34 (FIG. 14). After the slide-out module 3 is slid-out outwardly, the rubber gaskets 33, 34 of both the modules (the stationary module 2 and the slide-out module 3) get closer to a small distance in such a way that a certain space always remains between them acting as an "air spacer", thereby avoiding occurrence of "cold bridges". Therefore, a dual sealing provided by the rubber gaskets 33, 34 is formed in sealed connection locations between the stationary module 2 and the slide-out modules 3. The rollers 35 of the stationary module 32 are always arranged at its edge in such a way that the slide-out module 3 is able to move on these rollers 35. The rollers 36 of each of the slide-out modules 3 are mounted at its edge before the rubber gaskets 34 of the slide-out module 3 in such a way that when the slide-out module 3 retracts inside the stationary module 2, the rollers 35, 36 of both the modules become arranged one adjacent to another, i.e., they do not prevent each other from moving.

The transportable expandable structure 1 may comprise noise insulation elements, and any known means and materials may be used as these noise insulation elements.

The transportable expandable structure 1 may comprise the air ventilation system with recuperation, thereby providing fresh air intake without significant heat losses.

Operation (Use) of the Structure.

The transportable expandable structure 1 is for living/using it as a temporary room (or several rooms) being fully equipped in terms of life support or special needs. That is, this device may be equipped and used as a mobile medical station, a mobile command center, a mobile living room, for other similar purposes, but without limitation thereto. Features of the structure 1 provide its convenient loading/unloading and further transportation by means of various vehicles to locations of possible use, storage etc.

Loading for transportation. In most of embodiments of the invention, the structure 1 does not comprise any chassis and wheels, it is not a vehicle, and, accordingly, there is no need to register this structure 1 as a vehicle, since it is merely "a cargo" that is carried on the common trailer or in another way, e.g., on the cargo bay of the car. However, in separate embodiments, the structure 1 comprises the wheeled chassis that is arranged in the lower part of the stationary module 2 and, accordingly, this structure does not require any loading/unloading and it is used as "a trailer" of the vehicle.

In preferable embodiments of the invention, the structure 1 utilizes at least four lifting mechanisms 20. This structure 1 with the lifting mechanisms 20 is characterized by the possibility of its loading and unloading without any additional means particularly owing to mounting of said lifting mechanisms 20 for lifting and descending the structure 1 along the perimeter of the stationary module 2. Except for the four lifting mechanisms 20 of the stationary module 2, one lifting mechanism 20 also may be mounted for each of the slide-out modules 3.

If the structure 1 is in the folded state (where the slide-out modules 3 are retracted into the stationary module 2), then the structure 1 may be loaded onto the trailer or the cargo bay of the car for further transportation by means of the set of lifting mechanisms 20 of the stationary module 2. For example, if the slide-out modules 3 are retracted into the stationary module 2, while the slide-out module 3 rests on the horizontal surface (on the ground) on its four lifting mechanisms 20, then the stationary module 2 will be lifted vertically on its lifting mechanisms 20 to a height that enables the trailer or the cargo bay to drive in between the lifting mechanisms 20 under the bottom of the stationary module 2, and then, by means of the lifting mechanisms 20, the stationary module 2, i.e., substantially the entire folded structure 1, is descended, e.g., on the trailer. After the structure 1 is loaded onto the trailer, the lifting mechanisms 20 of the stationary module 2 are vertically "retracted" in order not to interfere with further movement of the vehicle. Then, the device may be transported to a location for future use.

If the transportable expandable structure 1 is in the unfolded state, i.e., when the slide-out modules 3 are slid-out and all the modules rest on the horizontal surface, on the lifting mechanisms 20, then the structure 1 also will be liftable on all the lifting mechanisms 20 to the height that enables the trailer or the cargo bay of the vehicle to drive in between the lifting mechanisms 20 under the bottom of the stationary module 2, and then, by means of the lifting mechanisms 20, the stationary module 2 is descended, e.g., on the trailer, while the slide-out modules 3 are "retracted" inside the stationary module 2. Accordingly, after the loading on the trailer is completed, all the lifting mechanisms 20 of all the modules 2, 3 are vertically "retracted" in order not to interfere with the further movement of the vehicle with the structure 1 loaded thereon. Then, this device is transported. The detailed description of details and the operation principle of the lifting mechanisms 20, their linear motors 25 as controlled by the control unit 29 has been provided above previously.

Removal of the Structure 1 from the Trailer or from the Cargo Bay of the Vehicle, when the Device Comprises the Lifting Mechanisms 20.

After the transportation is completed, it will become necessary to remove the transportable expandable structure 1 from the trailer. This can be done at least in two ways.

The first way is to remove the non-expanded structure 1 from the trailer by using the lifting mechanisms 20 of the stationary module 2. By means of the personal electronic digital device, the user supplies/transmits the corresponding signal command to the control unit 29 to "push-out" the lifting mechanisms 20 of the stationary module 2 downwards. Software of the control unit 29 transmits the corresponding signals to the linear motors 25 which start to operate and push, via and by means of the ball screw pairs 26 and reduction gears 27, the internal movable tubes 22 vertically downwards relative to the external stationary tubes 21 of the four lifting mechanisms 20 of the stationary module 2. As a result, the ends of the internal movable tubes 22 abut the horizontal support (e.g., the soil, concrete, asphalt), and the stationary module 2 relies on the four lifting mechanisms 20 which, in turn, already rest on the horizontal support. Then, by means of the personal electronic digital device, another signal about the vertical lifting of the lifting mechanisms 20 and the structure 1 above the trailer is supplied/sent to the control unit 29. Accordingly, the four lifting mechanisms 20 of the stationary module 2 start to operate in opposite direction, i.e., the linear motors 25 push the internal movable tubes 22 vertically upwards relative to the external stationary tubes 21 of the four lifting mechanisms 20 of the stationary module 2. The structure 1 lifts on the lifting mechanisms 20 above the trailer, and then the vehicle drives out from under the stationary module 2. Then, the slide-out modules 3, their lifting mechanisms 20 (if they are provided in the structure 1) may be expanded and the stationary module 2 or all the modules of the structure 1 may be horizontally aligned. The described process of removing the folded structure 1 from the trailer by means of the four lifting mechanisms 20 of the stationary module 2 may be equally used for the unfolded structure 1 as well, when the slide-out modules 3 are slid-out before the structure 1 is loaded onto the trailer and the slide-out modules 3 lack their own lifting mechanisms 20.

The second way to remove the structure 1 from the trailer is used, when the slide-out modules 3 also comprise, except for the four lifting mechanisms 20 of the stationary module 2, their own lifting mechanisms 20 of the stationary module 2, and the structure 1 must be "expanded" when it is still loaded onto the trailer. In these cases, before removing the structure 1 from the trailer, the slide-out modules 3 are slid-out and all the lifting mechanisms 20 of all the modules 2, 3 are pushed out vertically downwards. Then, the same actions as during removal of the non-expanded structure 1 from the trailer are performed.

Therefore, when the structure 1 utilizes the lifting mechanisms 20, it is possible to unload the structure 1 without any additional mechanisms when the structure 1 is folded owing to the operation of the lifting mechanisms 20 of the stationary module 2 as well as in the unfolded state owing to the operation of the lifting mechanisms 20 of the stationary module 2 or all the modules 2, 3 and owing to the sets of the expansion mechanisms 6 and the support mechanisms 13 of the slide-out modules which allow to expand the structure 1 on the trailer.

As mentioned above, all the lifting mechanisms 20 operate by moving vertically downwards and upwards according to the "tube in a tube" principle by means of the internal rollers 23 and the linear motors 25. The external stationary tubes 21 of the lifting mechanisms 20 are rigidly attached to the corresponding modules 2, 3, while the internal movable tubes 22 are movable relative to the external tubes 21, and the lower ends of the internal movable tubes 22 rely on the horizontal surface. The linear motors 25 of the lifting mechanisms 20 are powered externally.

In separate embodiments of the invention, in order to provide timely stops of the lifting mechanisms 20, the position sensors 60 and the weight sensors 28 which are connected to/communicate with the control unit 29 may be used. Software of the controller of the control unit 29 enables the user, by means of the personal electronic digital device, to operate the linear motors 25 and, accordingly, the movements of the lifting mechanisms 20 both together and separately, while providing each of the lifting mechanisms 20 with the vertical movement both simultaneously upwards or downwards and separately. That is, some lifting mechanisms 20 may move upwards, while some lifting mechanisms 20 may move downwards or may not move at all. Therefore, the entire transportable expandable structure 1 is horizontally aligned in a quick and convenient fashion.

If the transportable expandable structure 1 utilizes the tilt sensor or several tilt sensors (which are mounted in the stationary module 2 and connected to/in communication with the control unit 29), then the horizontal alignment of the structure and its elements will be controlled in a more accurate and efficient way.

Therefore, the set of the lifting mechanisms 20 with their linear motors 25 and with the controller's software of the control unit 29 enables to:

- lift or descend the modules 2, 3 of the structure 1 which, in turn, enables to load or unload the folded or unfolded structure 1 from the trailer/onto the trailer in a convenient and quick way without using any additional mechanisms;
- adjust and align the horizontal arrangement of the structure 1 and its modules 2, 3;
- hold the structure 1 on the lifting mechanisms 20 for a long time above the horizontal smooth or rough surface (ground, soil, asphalt, concrete etc.) in its deployment and usage location.

Removal of the structure 1 from the trailer or from the cargo bay of the vehicle, when the device does not comprise the lifting mechanisms 20, but rather comprises

- the support brackets or supporting and fastening elements for the horizontal mounting or mounting and fixation on the trailer or on the cargo bay of the vehicle, is made by means of additional means (crane, winch etc.).

As mentioned above, the transportable expandable structure 1 is configured to expand/retract, i.e., to slide out or to retract the slide-out modules 3 from inside the stationary module 2. When the slide-out modules 3 are slid-out, it will provide creation and operation of the additional "living" space in the structure 1.

The movable end of the rod 45 of the linear motor 44 is attached to the bracket 42. The linear motor 44 itself is mounted roughly at the central part of the support mechanism 13 in such a way that its rod 45 is parallel to the push-out tube 15 and adjacent to this push-out tube 15. Therefore, the rod 45 is bound to the push-out tube 15 via the bracket 42, but this binding may be provided in another way. The system formed by the linear motor 44 with the rod 45 comprises the casing 46 for the rod 45. The linear motor 44 is rigidly attached to one of the stationary U-shaped profile beams 14 by means of the bracket 47.

The slide-out modules 3 are moved owing to the operation of the sets of the expansion mechanisms 6 along with their own linear motors 10 and to the operation of the sets of the support mechanisms 13 along with their own linear motors 44 in combination with external power supply and with the operation of the control unit 29 and its controller having software. By means of the personal electronic digital device, the user transmits the corresponding signal to the control unit 29, and the control unit 2, in turn, transmits control signals for the movement start to the linear motors 10 of the expansion mechanisms 6 and to the linear motors 44 of the support mechanisms 13. In the lower part of the structure 1, the linear motors 10 start to move outwardly the internal movable push-out tubes 8 which the slide-out modules 3 are attached to, and the corresponding stationary guiding ties (external tubes) 7 remain static (rigidly attached to the stationary module 2 in the lower part). At the same time, the linear motors 44 (by means of the rods 45), in the upper part of the structure 1, start to move outwardly the push-out tubes 15 which the slide-out modules 3 are attached to, and the corresponding stationary U-shaped profile beams 14 remain static (rigidly attached to the stationary module 2 in the upper part). As mentioned above, the operation of all the linear motors 10 of the expansion mechanisms 6 and the linear motors 44 of the support mechanisms 13 is synchronized.

The synchronization of the operation of the internal movable push-out tubes 8 and their linear motors 10 of the expansion mechanism 6 may be implemented in various ways. In separate embodiments of the present invention, this synchronization may be provided in the following way. The magnet 11 is mounted on the rod of each of the linear motors 10, and the magnet sensors 12 which form the "check points" are mounted on the outer casing of each of the linear motors 10. When the rod with the magnet 11 of the certain linear motor 10 "passes" past this magnetic sensor 12, i.e., the "check point", the "actuation" will occur and the corresponding electronic signal will be sent from the "motor 1—check point" to the control unit 29. Therefore, software of the controller of the control unit 29 receives said signal and "knows" that the rod of the certain linear motor 10 has reached the certain "check point" that is formed by the corresponding magnetic sensor 12. Therefore, all the linear motors 10 of the internal movable push-out tubes 8 operate "under control" of the control unit 29 and, thus, owing to the settings of the software of the controller of the control unit 29, it becomes possible to make movements and stoppage of the linear motors 10 "synchronized". For example, the first check point of one of the internal movable push-out tubes 8 is located at a distance of 15 cm from the start point of the push-out tube 8 (generally, several "check points" which may be located approximately at the same distance may be defined along the entire distance of the movement of the internal movable push-out tubes 8). Accordingly, all the linear motors 10 simultaneously move the internal movable push-out tubes 8 at a slightly different speed (this difference may be minimum, however, even the minimum difference between the speed of the motors 10 and the movement of the internal tubes 8 may lead to jamming or imbalance of the slide-out modules 3 due to their significant weight). Once one of the linear motors 10 has reached the first check point (that is located, e.g., at said distance of 15 cm), the control unit 29 will receive the corresponding signal about it, and the control unit 29 will immediately transmit its own signal to stop this particular linear motor 10 that has already reached this check point, since other linear motors 10 of other internal movable push-out tubes 8 have not reached this check point yet. In the same way, each of the linear motors 10 is stopped by the control unit 29 after it has reached a certain own check point. Stoppages of the linear motors 10 will occur until all other linear motors 10 reach the certain check point. The next simultaneous movement of all the linear motors 10 will continue only when all of them have already reached certain check points. In the same way, the movement cycle of the linear motors 10 with the attached internal movable push-out tubes 8 of the expansion mechanisms 6 repeats until all the linear motors 10 will reach the second check point. There may be several these cycles of simultaneous movement. In this way, the synchronization of the internal movable push-out tubes 8 of the expansion mechanisms 6 with the slide-out modules 3 attached thereto takes place both outwardly and inwardly to the stationary module 2.

The described structural solution of the operation synchronization between the expansion mechanisms 6 and their linear motors 10 does not pose any limitation of the present invention, and any obvious or non-obvious types and means for providing this synchronization may be used. This movement synchronization system for the internal movable push-out tubes 8 with the slide-out modules 3 attached thereto may utilize various motors, tools for connecting them to the internal movable push-out tubes 8 and various sensors for forming the "check points", i.e., optical sensors, magnetic sensors, mechanical sensors, motion sensors, motor RPM control sensors etc.

The synchronized mechanical system of the expansion mechanisms 6 with the linear motors 10, the magnets 11 and the magnetic sensors 12 or with other similar sensors which form the "check points" in combination with the control unit 29 that is based on the controller with software enable to perform the uniform movement of the slide-out modules 3 and to control the simultaneous movements of the several internal movable push-out tubes 8 in the sets of the stationary guiding ties (external tubes) 7 so as to avoid any imbalance and jamming of the slide-out modules 3 in the lower part of the structure 1 when they slide out outwardly or retract inside the stationary module 2.

The slide-out modules 3 are supported and moved by the support mechanisms 13 with their own linear motors 44 in the upper part of the structure 1. As mentioned above, the support mechanisms 13 are formed by at least two stationary U-shaped profile beams 14 and the internal movable push-out tube 15 that is movably mounted between them and connected to the rod 45 of the linear motor 44, and each of the support mechanisms 13 comprises the first set of rollers 40, 41 that is mounted at the start point of the support mechanism 13 and the second set of rollers 16, 39 that is mounted at the end point of the support mechanism 13. In the best embodiment of the invention, the structure 1 comprises three pairs of the support mechanisms 13 with the ropes 18 and with six linear motors 44 for the four slide-out modules 3, where the corresponding horizontal internal movable push-out tubes 15 are attached to the slide-out modules 3 by means of the brackets 42. The linear motors 44 of all the support mechanisms 13 are connected to the control unit 29, and the operation of the linear motors 44 of the support mechanisms 13 is controlled by the control unit 29. All the linear motors 44 of all the support mechanisms 13 are synchronized between each other and they are also synchronized with the linear motors 10 of the expansion mechanisms 6. The operation synchronization of the linear motors 44 of the support mechanisms 13 between each other may be implemented in the same way as the operation synchronization of the linear motors 10 of the expansion mechanisms 6 or in any other way. The synchronization of the operation of the linear motors 10 (of the expansion mechanisms 6) and of the operation of the linear motors 44 (of the support mechanisms 13) between each other also may be implemented in any way, and this synchronization of the "upper" motors 44 and the "lower" motors 10 of the structure 1 is controlled by means of the control unit 29.

The synchronized mechanical system of the support mechanisms 13 with the linear motors 44, the magnets 11 and the magnetic sensors 12 which form the "check points" (in the same way as in the expansion mechanisms 6) in combination with the control unit 29 that is based on the controller with software enable to perform the uniform movement of the slide-out modules 3 and to control the simultaneous movements of the several internal movable push-out tubes 15 in the sets of the stationary U-shaped profile beams 14 so as to avoid any imbalance and jamming of the slide-out modules 3 in the upper part of the structure 1 when they slide out outwardly or retract inside the stationary module 2.

Accordingly, when the internal movable push-out tubes 8 of the expansion mechanisms 6 are moved by means of their own linear motor 10 in the lower part of the structure 1 together with the slide-out modules 3, then, at the same time, the internal movable push-out tubes 15 of the support mechanisms 13, under action of the linear motors 44 (which are connected to the tubes 15 via their own rods 45), will also move in the upper part of the structure 1 by means of the rollers 16, 39, 40, 41 between the stationary U-shaped profile beams 14 together with the slide-out modules 3. As mentioned above, the linear motors 10 and 44 operate in the synchronized fashion, i.e., each of said motors 10 and 44 starts or stops depending on the positions of the specific "lower" push-out tubes 8 and/or "upper" push-out tubes 15 at a certain time, and, accordingly, depending on the positions of the specific slide-out modules 3 (or their left/right/central part) at a certain time. This synchronization of the operation of the linear motors 10 and the linear motors 44 enables to synchronize the movements of the push-out tubes 8 and 15 of the corresponding expansion mechanisms 6 in the lower part of the structure 1 and the support mechanisms 13 in the upper part of the structure 1 which, in combination with the operation of the control unit 29 and other elements of the structure 1, allows to achieve the stable, uniform, smooth, mechanized and automated simultaneous sliding out of several slide-out modules 3 outwardly from the stationary module 2 as well as to achieve the stable, uniform, smooth, mechanized and automated simultaneous retraction of several slide-out modules 3 inside the stationary module 2 of the structure 1.

In each of the support mechanisms 13, two ropes 18 are arranged and fixed along each of the internal movable push-out tubes 15 in such a way that they provide the significant reinforcement at the top and at the bottom, thereby forming a counterforce of the internal movable push-out tube 15 in such a way that owing to the ropes 18, the internal movable push-out tubes 15 do not buckle under the weight of the slide-out parts 3. Accordingly, while the slide-out modules 3 are supported at the bottom, e.g., sometimes by the lifting mechanisms 20 and always by the internal movable push-out tubes 8 of the expansion mechanisms 6, in turn, the slide-out modules 3 at the top almost suspend on the pushed out internal movable push-out tubes 15 which are reinforced by their ropes 18. Even if the slide-out modules 3 lack their own lifting mechanisms 20 and they do not have any lower support, the rigidity of the internal movable push-out tubes 15 with the ropes 18 and with the base in the form of the stationary U-shaped profile beams 14 is fully sufficient for providing the full-scale holding of the slide-out modules 3 in the stable position.

Each of the internal movable push-out tube 15, on either side by means of the linear motors 44 and by means of the sets of rollers 16, 39, 40, 41, is configured to push out outwardly from the stationary module 2 together with the attached slide-out module 3, e.g., to a distance from 115 cm to 120 cm, but without limitation thereto. In the same way, during retraction of the slide-out modules 3 back to the stationary module 3, the movable tubes 15 with the ropes 18 of the support mechanisms 13 are retracted inwardly between the systems of the stationary U-shaped profile beams 14.

Therefore, the system of the support mechanisms 13 and, in particular, the above-described structural features of the support mechanisms 13, their binding to the stationary module 2 and to the slide-out modules 3, facilitate the horizontal movement of the slide-out modules 3 in two directions and enable long-term holding of the slide-out modules 3 in the upper part of the structure, when the slide-out modules 3 are in the expanded state.

When the expandable roof 48 is used in the structure 1, then during the expansion of the slide-out modules 3, the expandable parts 50 will move together with the slide-out modules 3, while the location of the stationary part 49 of the expandable roof 48 will remain unchanged above the stationary module 2 (FIG. 16). Accordingly, in this position, the expandable parts 50 cover and protect the movable (slid-out) elements of the support mechanisms 13 against environmental exposure in the areas of the slid-out modules 3, while the stationary part 49 covers and protects the stationary elements of the support mechanisms 13 which are arranged stationary in the upper part of the stationary module against environmental exposure.

When the structure 1 is in the folded position (FIG. 17), the expandable parts 50 of the expandable roof 48 will be arranged under the stationary part 49 and, accordingly, all the elements of the expandable rood 48 will cover and protect the support mechanisms 13 against environmental exposure.

All the electronic/electrical details and mechanisms of the structure 1 which require "external control" are connected to the control unit 29 having special software installed therein. If necessary, the user of the structure, by means of the personal electronic digital device, provides the required signals about "expansion", "retraction", "stoppage of the movements of the slide-out modules in any direction", "expansion/retraction of the arms", "horizontal alignment", control of the life support systems to the control unit 29 via the communication means (Bluetooth module, Wi-Fi module) of the structure 1. All operational functions of the structure may be completely automated by means of software settings of the control unit 29 and the personal electronic digital user device.

The transportable expandable structure 1 is suitable for usage during all seasons owing to the described thermal insulation elements, noise insulation elements and owing to the standard heating systems and water supply systems which meet the standards of common living rooms. The noise insulation of the internal walls and doors of the stationary module 2 and of the slide-out modules 3 increases the accommodation comfort for several persons. The air ventilation system with recuperation provides the fresh air intake without significant heat losses.

Examples of a specific industrial embodiment of the claimed invention, its use are mentioned above as the best exemplary embodiments.

The claimed structure 1 has passed wide tests during its experimental production as well as during its experimental usage in various conditions and on various horizontal surfaces, i.e., on the asphalt and concrete surface, soil, grass surface, stony surfaces, sandy surfaces etc.

The claimed transportable expandable structure meets all the requirements for its use, as well as the commonly accepted safety rules for use of such structures.

The invention claimed is:

1. A transportable expandable structure (1) comprising:

a stationary module (2) that comprises a floor, two opposite walls, a ceiling and at least one door opening, at least two slide-out modules (3) that are accommodated inside the stationary module (2) and are movable and slidable out in width outwardly from the stationary module (2), and each slide-out module (3) comprises a slide-out module floor, at least three walls and a slide-out module ceiling, the transportable expandable structure (1) comprises a plurality of expansion mechanisms (6) configured for sliding out the slide-out modules (3) outwardly from the stationary module (2) and a plurality of support mechanisms (13) configured for supporting the slide-out modules (3), and the expansion mechanisms (6) are mounted in the transportable expandable structure (1) horizontally in width in such a way that elements of the expansion mechanisms (6) are attached to the stationary module (2) and to the slide-out modules (3), and each expansion mechanism (6) is formed by at least a stationary guiding tie (7), a movable push-out element (8) and rollers (9), and the support mechanisms (13) are mounted in an upper part of the structure (1) horizontally in width in such a way that elements of the support mechanisms (13) are attached to the stationary module (2) and to the slide-out modules (3), and each support mechanism (13) comprises at least a stationary profile beam (14), a movable push-out element (15) and rollers (39), the transportable expandable structure (1) comprises a power supply system configured to provide illumination and power supply for the stationary module (2) and each of the slide-out modules (3), wherein a stationary frame (4) with trusses (5) is arranged in a lower part of the structure (1), the trusses are stationary and immovable elements, and the stationary module (2) with the slide-out modules (3) is mounted on the trusses, the transportable expandable structure (1) comprises a control unit (29) having a controller, a software and wireless communication means, and the control unit (29) is in a communication with control elements for controlling movements of the expansion mechanisms (6) and with all electronic elements of the transportable expandable structure (1), and each expansion mechanism (6) is mounted in a lower part under a floor of the stationary module (2) between sections of the stationary frame (4) and is arranged horizontally in width and transversely to the stationary module (2), and each expansion mechanism (6) is a tube in a tube system having a nested configuration, where an external tube of the tube in tube system is the stationary guiding tie (7), while an internal movable push-out tube (8) is the movable push-out element, and the rollers (9) are mounted between walls of the stationary guiding tie (7) and of the internal movable push-out tube (8), and the stationary guiding tie (7) of each expansion mechanism (6) is rigidly fixed to the stationary frame (4) in the lower part of the stationary module (2), while the internal movable push-out tube (8) of each of the expansion mechanisms (6) is rigidly connected to a lower horizontal plane of a corresponding said slide-out module (3), each expansion mechanism (6) comprises a linear motor (10) that is mounted adjacent to a corresponding said stationary guiding tie (7), and a rod of the linear motor (10) is rigidly connected to a corresponding said internal movable push-out tube (8) in order to provide the corresponding tube with a mechanical horizontal movement, and all the linear motors (10) of all of the expansion mechanisms (6) are connected to the control unit (29), and all the expansion mechanisms (6) and linear motors (10) are synchronized between each other, and each support mechanism (13) is formed by at least three profile elements, namely, from two stationary U-shaped profile beams (14) and an internal movable push-out tube (15) that is movably mounted therebetween, and each said support mechanism (13) comprises a first set of rollers (40), (41) that is mounted at a start point of the support mechanism (13) and a second set of rollers (16), (39) that is mounted at an end point of the support mechanism (13), each said support mechanism (13) comprises at least two vertical masts (17) that are oppositely mounted on the internal movable push-out tubes (15), while two reinforcing ropes (18) extending through openings (19) of the masts (17) along an entire corresponding internal movable push-out tube (15) at a top and at a bottom, and ends of the ropes are fixed at ends of the corresponding internal movable push-out tube (15), and each said support mechanism (13) comprises a linear motor (44) that is fixed to one of the stationary U-shaped profile beams (14), and a rod (45) of the linear motor (44) is rigidly connected to the corresponding internal movable push-out tube (15) in order to provide the internal movable push-out tube with a mechanical horizontal movement, and all the linear motors (44) of all of the support mechanisms (13) are connected to the control unit (29), and all the support mechanisms (13) and linear motors (44) are synchronized between each other as well as synchronized with the expansion mechanisms (6) and with linear motors (10), and each said support mechanism (13) is mounted in the upper part of the structure (1) horizontally in width and transversely to the stationary module (2) such that the stationary U-shaped profile beams (14) of the support mechanisms (13) are rigidly attached to a horizontal plane of the ceiling of the stationary module (2), and the internal movable push-out tubes (15) are rigidly attached to vertical planes of the ceilings of the corresponding slide-out modules (3) by means of brackets (42).

2. The transportable expandable structure (1) according to claim 1, wherein a magnet (11) is mounted on the rod of each linear motor (10) of each of the expansion mechanisms (6), and magnetic sensors (12) are mounted on an external casing of each of these linear motors (10), the magnetic sensors form check points for transmitting, to the control unit (29), certain signals about certain positions of the linear motors (10) and of the internal movable push-out tubes (8) which the slide-out modules (3) are attached to.

3. The transportable expandable structure (1) according to claim 1, further comprising four slide-out modules (3) which are mounted so as the slide-out modules (3) are slidable out and retractable in pairs from each side of the stationary module (2), and the pairs of the slide-out modules (3) sliding-out towards one side are rigidly bound together, and six support mechanisms (13) which are arranged pairwise are mounted in the upper part of the structure (1) horizontally in width and transversely to the stationary module (2), meaning that there are totally three pairs of support mechanisms (13) which are arranged such that one paired support mechanism (13) is arranged at a center of the structure (1), while two other paired support mechanisms (13) are arranged at edges along a front part and a rear part of the structure (1), and, accordingly, each pair of the slide-out modules (3) bound together is connected to the three support mechanisms (13) in the upper part, besides, four expansion mechanisms (6) are mounted pairwise in the lower part of the structure (1) in the frame (4) such that one expansion mechanism (6) of each pair is movable in one direction from the stationary module (2), while another expansion mechanism (6) of each pair is movable in an opposite direction from the stationary module (2).

4. The transportable expandable structure (1) according to claim 1, wherein a magnet (11) is mounted on the rod (45) of each linear motor (44) of each of the support mechanisms (13), while magnetic sensors (12) are mounted on an external casing (46) of each of these linear motors (44), the magnetic sensors form check points for transmitting, to the control unit (29), certain signals about certain positions of the linear motors (44) and of the internal movable push-out tubes (15) which the slide-out modules (3) are attached to.

5. The transportable expandable structure (1) according to claim 1, wherein an additional U-shaped stationary profile beam (37) is mounted within the support mechanism (13) adjacent and parallel to each of the stationary U-shaped profile beams (14), and these beams (14) and (37) mounted in parallel are bound together by an upper U-shaped profile element (38) at upper parts along an entire length thereof.

6. The transportable expandable structure (1) according to claim 1, wherein the stationary U-shaped profile beams (14), (37) in the support mechanism (13) are mounted and fixed on additional profile elements and tubes (43) in order to provide a rigidity of the structure and to fix elements of the support mechanism (13) to the stationary module (2) and to the slide-out modules (3).

7. The transportable expandable structure (1) according to claim 1, further comprising support brackets or supporting and fastening elements for providing a horizontal mounting or mounting and fastening on a trailer or on a cargo bay of a vehicle.

8. The transportable expandable structure (1) according to claim 1, further comprising a wheeled chassis that is arranged in the lower part of the stationary module (2).

9. The transportable expandable structure (1) according to claim 1, wherein the control unit (29) comprises wireless communication means and software which are configured to exchange signals, data and information with personal electronic digital user devices.

10. The transportable expandable structure (1) according to claim 1, further comprising an expandable roof (48) that comprises a stationary part (49) and movable expandable parts (50), and the stationary part (49) of the roof is mounted and rigidly fixed above the ceiling of the stationary module (2), while the expandable parts (50) of the roof are mounted and rigidly fixed above the ceilings of the movable modules (3), and cavities for receiving the expandable parts (50) of the roof are formed under the stationary parts (49) of the roof and above the ceiling of the stationary module (2), while openings for providing free movement of the movable expandable parts (50) of the roof outwardly and inwardly under the stationary part (49) of the roof are arranged on either side of the stationary part (49) of the roof, and the expandable parts (50) of the roof are formed of a frame base (59), while upper horizontal planes (53), vertical front and rear plates (54) and vertical lateral planes (55) are attached to the frame base, and guiding elements (51) for the expandable parts (50) of the roof are mounted on an internal horizontal plane of the stationary part (49) of the roof perpendicularly to a length of the stationary part (49) of the roof, and profile elements (52) corresponding to the guiding elements (51) are mounted on the upper horizontal planes (53) of the expandable parts of the roof, besides, vertical tubes (56) are attached to the frame base (59) on lateral edges of the expandable parts (50) in an area of the vertical planes (55), while internal bars (57) are mounted inside the vertical tubes in a vertically movable fashion, and upper ends of the bars are connected to the edges of the corresponding upper horizontal planes (53) of the corresponding expandable parts (50) of the roof, and planar vertical flaps (58) are connected to external edges of the upper horizontal planes (53), while the flaps are movable in connection points and are horizontally arranged along the corresponding lateral vertical planes (55) along an entire length of each lateral side of each corresponding expandable part (50) of the roof.

11. The transportable expandable structure (1) according to claim 1, further comprising three pairs of the support mechanisms (13) having the corresponding sets of rollers (16), (39), (40), (41), and each of the three pairs of the support mechanisms (13) comprises two internal movable push-out tubes (15), and each tube is connected to the rod (45) of the corresponding individual linear motor (44), and at least four stationary U-shaped profile beams (14) which are arranged and made such that two internal movable push-out tubes (15), by means of the corresponding linear motors (44), are movable and slidable out and retractable in opposite directions, while all the stationary U-shaped profile beams (14) remain stationary.

12. The transportable expandable structure (1) according to claim 11, wherein the stationary U-shaped profile beams (14) of the pairs of the support mechanisms (13), while the beams are arranged adjacent and parallel in upper parts, are bound together by the upper U-shaped profile element (38) along an entire length thereof.

13. The transportable expandable structure (1) according to claim 1, further comprising at least four lifting mechanisms (20) having elements which are movable vertically upwards and downwards, and four or more lifting mechanisms (20) are vertically mounted and attached either to the stationary module (2) or to both the stationary module (2) and the slide-out modules (3), and each lifting mechanism (20) comprises the tube in a tube system having internal rollers (23), the tube in a tube system is formed by an external stationary tube (21) and by an internal movable tube (22), while the rollers (23) are mounted between walls of the external stationary tube (21) and walls of the internal movable tube (22), and each external stationary tube (21) is rigidly fixed to a respective said module, while each internal movable tube (22) is mounted so as to be movable vertically upwards and downwards relative to the external stationary tube (21) and, accordingly, relative to the respective module which this external stationary tube (21) is fixed to, besides, each lifting mechanism (20) comprises a linear motor (25), a reduction gear (27) and a ball screw pair (26) which together form a motion transmission assembly for transmitting motion upwards and downwards from the linear motor (25) to the internal movable tube (22), besides all the linear motors (25) of all of the lifting mechanisms (20) are connected to the control unit (29).

14. The transportable expandable structure (1) according to claim 13, wherein the lifting mechanisms (20) comprise weight sensors (28) and position sensors (60) which are connected to the control unit (29), besides, the stationary module (2) has tilt sensors which are mounted therein and are also connected to the control unit (29).

15. The transportable expandable structure (1) according to claim 1, further comprising at least one of a ventilation system, a heating system, a water supply-sewerage system, a thermal insulation system or a noise insulation system.

16. The transportable expandable structure (1) according to claim 15, wherein a box structure (30) is mounted under the floor and under a bottom of the stationary module (2), the box structure has rigid tubes (31) arranged inside thereof, the rigid tubes are interconnected by flexible hoses (32) and supply water and heat to the slide-out modules (3), and the interconnected rigid tubes (31) and the flexible hoses (32) are connected to other water supply and heat supply means which are arranged in the stationary module (2) and in the slide-out modules (3).

17. The transportable expandable structure (1) according to claim 15, wherein thermal insulation plates or polyisocyanurate plates are used as thermal insulation elements for the walls, the ceilings and other elements of at least one of the stationary module (2) or the slide-out modules (3), while a vacuum glass is used for windows and for other transparent elements of the transportable expandable structure (1).

18. The transportable expandable structure (1) according to claim 15, wherein rubber gaskets (33) are mounted on all edges of the stationary module (2) which are connected to the slide-out modules (3), and rubber gaskets (34) are mounted on all edges of rear parts of each slide-out module (3) which are connected to the stationary module (2), while rollers (35) of the stationary module (2) and rollers (36) of the corresponding slide-out modules (3) are mounted between said rubber gaskets (33), (34).

* * * * *